US009566202B2

(12) United States Patent
Chiang et al.

(10) Patent No.: US 9,566,202 B2
(45) Date of Patent: Feb. 14, 2017

(54) MEDICAL AIR MATTRESS, METHOD TO INFLATE/DEFLATE A MEDICAL AIR MATTRESS AND METHOD TO INCLINE THE BEARING SURFACE OF A MEDICAL AIR MATTRESS

(75) Inventors: Kuang-Neng Chiang, Taipei (CN); Hsui-Lun Liang, Taipei (CN)

(73) Assignee: Picard Healthcare Technology (Dongguan Co. Ltd.), Dongguan (CN)

( * ) Notice: Subject to any disclaimer, the term of this patent is extended or adjusted under 35 U.S.C. 154(b) by 0 days.

(21) Appl. No.: 14/125,336

(22) PCT Filed: Jun. 18, 2012

(86) PCT No.: PCT/IB2012/001202
§ 371 (c)(1),
(2), (4) Date: Dec. 11, 2013

(87) PCT Pub. No.: WO2012/172421
PCT Pub. Date: Dec. 20, 2012

(65) Prior Publication Data

US 2014/0173825 A1 Jun. 26, 2014

(30) Foreign Application Priority Data

Jun. 16, 2011 (EP) ..... 11170166
Jun. 16, 2011 (EP) ..... 11170191

(51) Int. Cl.

| | |
|---|---|
| ***A61G 7/057*** | (2006.01) |
| ***A47C 27/10*** | (2006.01) |
| ***A61G 7/00*** | (2006.01) |
| ***A61G 7/05*** | (2006.01) |
| ***A47C 21/00*** | (2006.01) |
| ***A47C 21/04*** | (2006.01) |
| ***A47C 27/08*** | (2006.01) |

(52) U.S. Cl.
CPC ..... *A61G 7/05776* (2013.01); *A47C 21/00* (2013.01); *A47C 21/048* (2013.01); *A47C 27/081* (2013.01); *A47C 27/10* (2013.01); *A61G 7/00* (2013.01); *A61G 7/0525* (2013.01)

(58) Field of Classification Search
CPC ... A47C 27/081; A47C 27/082; A47C 27/083; A47C 27/10; A47C 21/00; A47C 21/048; A61G 7/05776; A61G 7/0525; A61G 7/00
USPC ... 5/421, 425, 706, 710, 713, 715, 717, 724, 5/739, 654, 655.3, 915
See application file for complete search history.

(56) References Cited

U.S. PATENT DOCUMENTS

| | | | | |
|---|---|---|---|---|
| 2,998,817 A * | 9/1961 | Armstrong | ..... | 601/149 |
| 3,653,083 A * | 4/1972 | Lapidus | ..... | 5/713 |
| 3,678,520 A * | 7/1972 | Evans | ..... | 5/713 |
| 4,193,149 A * | 3/1980 | Welch | ..... | A61G 7/05776 5/713 |

(Continued)

*Primary Examiner* — David E Sosnowski
*Assistant Examiner* — David R Hare
(74) *Attorney, Agent, or Firm* — Fay Sharpe LLP

(57) ABSTRACT

A medical air mattress has a mattress body, a lower bedspread and an upper bedspread. The mattress body is formed by multiple air cells substantially parallel arranged in a row forming an air cell row. The upper bedspread covers the mattress body and is securely connected to the lower bedspread. The mattress further comprises a pumping assembly with a pump and at least a pipeline connecting the pump with the air cells such that inflating and/or deflating of the air cells is controllable selectively.

34 Claims, 27 Drawing Sheets

(56) References Cited

U.S. PATENT DOCUMENTS 4,617,690 A * 10/1986 Grebe ..... 5/713
4,953,247 A * 9/1990 Hasty ..... A61G 7/05776 137/625.66
5,005,240 A * 4/1991 Vrzalik ..... 5/713
5,267,364 A * 12/1993 Volk ..... 5/713
5,394,577 A * 3/1995 James et al. ..... 5/713
5,437,608 A * 8/1995 Cutler ..... 601/49
5,564,142 A * 10/1996 Liu ..... 5/689
5,647,079 A * 7/1997 Hakamiun ..... A61G 7/05776 285/124.3
5,685,036 A * 11/1997 Kopfstein et al. ..... 5/713
5,701,622 A * 12/1997 Biggie et al. ..... 5/713
5,774,917 A * 7/1998 Liu ..... 5/715
5,956,787 A * 9/1999 James et al. ..... 5/713
6,085,372 A * 7/2000 James et al. ..... 5/713
6,370,716 B1 * 4/2002 Wilkinson ..... 5/715
6,523,198 B1 * 2/2003 Temple ..... 5/604
6,564,411 B2 * 5/2003 Pirzada ..... 5/713
6,604,252 B1 * 8/2003 Lee et al. ..... 5/715
6,694,556 B2 * 2/2004 Stolpmann ..... 5/710
6,695,789 B2 * 2/2004 Thede et al. ..... 600/494
6,695,798 B2 * 2/2004 Chang ..... 601/49
6,725,485 B2 * 4/2004 Hayes ..... 5/695
6,813,790 B2 * 11/2004 Flick et al. ..... 5/713
6,826,795 B2 * 12/2004 Wilkinson ..... 5/713
6,892,405 B1 * 5/2005 Dimitriu et al. ..... 5/615
7,107,640 B2 * 9/2006 Chapman et al. ..... 5/710
8,038,632 B2 * 10/2011 Flick et al. ..... 601/46
8,789,224 B2 * 7/2014 Wyatt et al. ..... 5/710
2003/0046762 A1 * 3/2003 Stolpmann ..... 5/421
2004/0031103 A1 * 2/2004 Wyatt et al. ..... 5/710
2004/0107503 A1 * 6/2004 Tu ..... A47C 27/082 5/710
2006/0117488 A1 * 6/2006 Hung ..... A47C 27/082 5/713
2007/0186349 A1 * 8/2007 Lipman et al. ..... 5/713
2008/0201858 A1 * 8/2008 Caminade ..... A61G 7/05776 5/713
2008/0271253 A1 * 11/2008 Pile ..... 5/710
2008/0307582 A1 * 12/2008 Flocard et al. ..... 5/712
2009/0100604 A1 * 4/2009 Caminade et al. ..... 5/713
2009/0193590 A1 * 8/2009 Hata ..... A61G 7/05776 5/713
2010/0180384 A1 * 7/2010 Balonick et al. ..... 5/709
2011/0041246 A1 * 2/2011 Li et al. ..... 5/421
2012/0110734 A1 * 5/2012 An ..... 5/423
2012/0291204 A1 * 11/2012 Takeda et al. ..... 5/710
2012/0311783 A1 * 12/2012 Chiang et al. ..... 5/421
2012/0311790 A1 * 12/2012 Nomura et al. ..... 5/710

* cited by examiner (State of the art)

MEDICAL AIR MATTRESS, METHOD TO INFLATE/DEFLATE A MEDICAL AIR MATTRESS AND METHOD TO INCLINE THE BEARING SURFACE OF A MEDICAL AIR MATTRESS

The present invention claims priority on PCT Application Serial No. PCT/EP2012/002197 filed May 23, 2012, which in turn claims priority on German Patent Application Serial No. 10 2011 101 256.9 filed May 23, 2011.

FIELD OF THE INVENTION

The present invention is related to a medical air mattress, especially to a medical air mattress for anti-decubitus purposes. Thus the medical air mattress comprises a lower bedspread and a mattress body mounted on the lower bedspread. The mattress body comprises multiple body air cells substantially parallel to each other arranged in a row forming an air cell row. The mattress can additionally comprise head air cells, wherein the head air cells are arranged at a head end in the air cell row. The mattress further comprises an upper bedspread covering the mattress body and connected securely to the lower bedspread. It further comprises a pumping assembly with a pump and at least a pipeline connecting the pump with the air cells.

The invention is further related to a method for inflating and/or deflating a generic medical air mattress, to a method to incline the surface of a medical air mattress according and to a method to generate in medical air mattress a position for receiving a container.

TECHNICAL BACKGROUND

Patients who have physical difficulties with mobility or bedfast mostly lie on a mattress over a long period of time and are thus susceptible to develop decubitus ulcers on multiple areas of body due to continuous pressure. In order to minimize or eliminate the development of decubitus ulcers caretakers must turn patients' body over or move patient to alternate the areas of pressure on the body. The conventional medical air mattress was developed to assist in the manual movement of and alternating pressure areas on the patient to generate wave motion for changing the contact areas of the patient's body. The conventional medical air mattress has the following inadequacies.

To assist patients in turning over, two inclination providing cells are mounted under the body air cells. When the patients need to turn over, one of the inclination providing cells inflates to tilt the conventional air mattress. This design offers only one inclination angle. Patients with varying disabilities will require different inclination positions, which are decided by physicians or the patient's discomfort. In the event that the patient requires a different angle than that offered by the conventional air mattress caretakers may use non-recommended accessories or the therapy cannot be provided. Either of these options put the patient at risk of injury.

Because the patients lying on the conventional air mattress have difficulty with mobility or bedfast, the protective apparatus around the conventional air mattress is important to keep the patient from falling off of the mattress. Hospital beds, which a medical mattress is used on, are equipped with guardrails, which at times can prohibit medical staff from taking care of the patients lying on the hospital beds and cannot always be in optimal position for patient protection. Many patients require the continued therapy of a medical air mattress in their homes. The medical air mattress is also required to assist caretakers moving the patient with minimal manual labor. In many cases the home is not equipped with guardrails on the bed that the medical air mattress is being used. The conventional medical air mattress can have air filled guardrails to protect patients and to assist caretakers, who can easily press down the air guardrails. If the patient accidentally compresses either air guardrail, such air guardrails will slant outward and cannot protect the patient anymore, causing the opportunity for the patient to fall from mattress. Such air guardrails have no connection with the upper bedspreads, only being connected to the lower bedspreads restrict the ability to have mutual-drawing power to each other from two-side on the upper bedspreads.

Further difficulties with handling a conventional air mattress occur when the patients lying on the mattress need to use a bedpan. The conventional air mattress has several detachable air cells, which correspond to the position of the patient's hip. A mattress according to the state of the art is presented in FIG. 11A, which is described more detailed later. When the detachable air cells are removed to form a recess, the bedpan will be able to be put into the recess for use. However, to prevent secondary infection and to be cleaned with ease, the conventional air mattress has an upper bedspread to cover on the air cells. Therefore, the upper bedspread needs to be removed before the detachable air cells are removed. Removing the upper bedspread still requires the need to move the patient lying on the conventional air mattress. The design of detachable air cells is inconvenient to caretakers since the patient still needs to leave the conventional air mattress. Furthermore moving the patient and removing the upper bedspread requires two or more individuals. This is an inefficient use of time and human resources, and the detachable air cells do not function as what the original design expected.

DESCRIPTION OF THE INVENTION

It is an object of the present invention to provide a medical air mattress with improved handling, improved possibilities to assist movement of the patient and to mitigate or obviate the aforementioned inadequacies. This problem is solved by a medical air mattress according to the present invention. Thus the pipeline connected to the pump and/or to the air cells is adapted to control inflating and/or deflating of the air cells selectively. With respect to this selectively means, that a chosen air cell or a group of chosen air cells can be inflated and/or deflated independently without inflating and/or deflating the rest of the air cells, that is to say without inflating and/or deflating one or more not chosen air cells.

The problem according to the invention is further solved by a method for inflating and/or deflating a medical air mattress by a method to incline the surface of a medical air mattress and by a method to generate in a medical air mattress a position for receiving a container. Preferred embodiments of the invention are presented in the dependent claims.

In order to generate movement in the bearing surface of the medical air mattress and in order to incline the surface of the mattress it is suggested to provide the medical air mattress with an odd body pipeline connecting the pump with the air cells at odd positions of the air cell row and with an even body pipeline connecting the pump with the air cells at even positions of the air cell row.

In order to improve the handling of a medical air mattress it is suggested to deflate some or all components of the medical air mattress according the invention in a very quick way—e. g. in case of an medical emergency—by a rapidly releasing valve. It can be connected to the pipeline, preferably to the odd body pipeline and the even body pipeline.

In order to provide a multiple inclination mode of the medical air mattress according to the invention additional inclination providing air cells are provided. The inclination providing air cells are mounted longitudinally on the lower bedspread, preferably such that the mattress body is mounted across the inclination providing air cells, near two longitudinal sides of the lower bedspread, and substantially parallel to each other. Thus the inclination of the surface of the mattress in order to move the patient can (additionally) be modified by inflating/deflating the inclination providing air cells independently, that is to say without inflating and/or deflating other air cells of the mattress.

According to a further aspect of the invention each air cell is gradually tapered in diameter from a wide end to a narrow end. The air cells are arranged with wide ends adjacent to the narrow ends. This on the one hand improves the anti decubitus performance of the medical air mattress so that it can be handled in a more simple way. On the other hand by inflating and/or deflating the gradually tapered body air cells selectively the surface of the mattress can be inclined.

According to a further aspect of the invention a guardrail with guardrail air cells and a guardrail pipeline are provided. The guardrail pipeline connects the pump with the guardrail air cells. By providing a medical air mattress with an inflatable/deflatable guardrail assembly injuries of the patient can be avoided. Moreover the handling of the guardrail is simplified by the medical air mattress according to the invention, because it can be removed by deflating the guardrail air cells independently. Bringing the guardrail in its guarding position can be done by inflating the guardrail air cells.

In order to further improve the handling of the medical air mattress it is suggested to provide mutual-drawing guardrail sleeves to keep the guardrail sleeves from tilting when being pressed. The medical air mattress can additionally have guardrail unit. The upper bedspread covering the mattress body has at least a guardrail sleeve fixed on at least one side of the upper bedspread. The guardrail unit can have multiple guardrail air cells mounted respectively in guardrail sleeves. The guardrail sleeves are formed on the upper bedspread, the upper bedspread and the guardrail sleeves will draw each other on two-side to ensure the guardrail sleeves remain in position when pressed. Therefore, the guardrail sleeves will not fall down when pressed and continue to provide optimal protection for the patient as its intended purpose.

Further improvement of the anti decubitus performance of the mattress is achieved by providing a massage unit mounted on the mattress body, preferably having multiple micro vibrators. Alternatively or additionally the medical air mattress according to the invention can be equipped with a heat unit in form of an electro thermal sheet.

In order to further simplify the handling of the mattress and specially to generate a position for receiving a bedpan or any other kind of container without significantly moving the patient independent air cells can be arranged at a central part in the air cell row. The independent air cells can be connected to the pumping assembly. According to this aspect of the invention the mattress body is formed by multiple air cells including independent air cells parallel arranged as an air cell row. The independent air cells can be connected to the independent deflating unit to be deflated independently. When the patient needs to use the bedpan, the independent air cells are deflated to form a recess for receiving the bedpan so that the bedspread and the patient have no need to be moved.

In summary, there is provided a medical air mattress comprising a lower bedspread, a mattress body mounted on the lower bedspread, which mattress comprises multiple body air cells and, preferably, multiple head air cells, substantially parallel to each other and arranged in a row forming an air cell row; an upper bedspread covering the mattress body, connected securely to the lower bedspread, and a pumping assembly comprising a pump, and at least a pipeline connecting the pump with the air cells, wherein the pipeline connecting the pump with the air cells is designed to control inflating and/or deflating of the air cells selectively. In one non-limiting embodiment, there is provided an odd body pipeline connecting the pump with the air cells at odd positions of the air cell row, and an even body pipeline connecting the pump with the air cells at even positions of the air cell row. In one non-limiting embodiment, there is provided a rapidly releasing valve connected to the pipeline, preferably to the odd body pipeline and the even body pipeline. In one non-limiting embodiment, there is provided two inclination providing air cells mounted longitudinally on the lower bedspread, preferably such that the mattress body is mounted across the inclination providing air cells, near two longitudinal sides of the lower bedspread, and substantially parallel to each other. In one non-limiting embodiment, each air cell is gradually tapered in diameter from a wide end to a narrow end, and the air cells being arranged with wide ends adjacent to the narrow ends. In one non-limiting embodiment, there is provided a guardrail with guardrail air cells, and in a guardrail pipeline connecting the pump with the guardrail air cells. In one non-limiting embodiment, the guardrail further comprises at least one guardrail sleeve fixed on at least one side of the upper bedspread, respectively formed adjacent to the longitudinal edges of the upper bedspread, each guardrail sleeve having at least one sleeve body. In one non-limiting embodiment, the guardrail further comprises a guardrail unit mounted in the guardrail sleeve, the guardrail unit comprising at least one guardrail air cell, and the guardrail air cell mounted in the sleeve body of the guardrail sleeve. In one non-limiting embodiment, each guardrail sleeve has two sleeve bodies formed separately, preferably aligning with and coaxial to each other. In one non-limiting embodiment, the guardrail sleeve has a flat base, preferably with a double stitched line, and directly fixed on the surface of the upper bedspread. In one non-limiting embodiment, there is provided a massage unit mounted on the mattress body, preferably having multiple micro vibrators. In one non-limiting embodiment, there is provided a heat unit in the form of an electrothermal sheet. In one non-limiting embodiment, the heat unit is attached to the upper bedspread. In one non-limiting embodiment, the heat unit is made of carbon fiber. In one non-limiting embodiment, the pumping assembly further comprises a body alternating-valve connected to the pump, preferably between the pump with body pipelines and the guardrail pipeline, a first check valve connected between the odd body pipeline and head air cells at odd positions of the air cell row, and a second check valve connected between the even body pipeline and head air cells at even positions of the air cell row. In one non-limiting embodiment, the pumping assembly further comprises a guardrail solenoid valve connected between the body alternating-valve and the guardrail pipeline, and a third check valve mounted between the body alternating-valve and the guardrail solenoid valve, and/or an inclination providing solenoid valve connected to the pump, and an inclination providing alternating-valve connected between the inclination providing solenoid valve and the inclination providing pipeline, and/or an inclination providing solenoid valve connected to the pump, and an inclination providing the alternating-valve connected between the inclination providing solenoid valve and the inclination providing pipeline. In one non-limiting embodiment, each body air cell and/or each head air cell is essentially uniform in diameter. In one non-limiting embodiment, the pumping assembly further comprises a body alternating-valve connected between the pump with the body pipelines and the guardrail pipeline, a first check valve connected between the odd body pipeline and the head air cells at odd positions of the air cell row, and a second check valve connected between the even body pipeline and the head air cells at even positions of the air cell row. In one non-limiting embodiment, the pumping assembly further comprises a manual alternating device connected between the body alternating-valve and the guardrail pipeline, and a third check valve mounted between the body alternating-valve and the manual alternating device. In one non-limiting embodiment, there is provided independent air cells arranged at a central part in the air cell row and connected to the pumping assembly. In one non-limiting embodiment, the pumping assembly comprises an independent deflating unit connected to the independent air cells. In one non-limiting embodiment, each body air cell and/or each head air cell and each independent air cell is respectively uniform in diameter. In one non-limiting embodiment, each independent air cell gradually tapers in diameter from a wide end to a narrow end. In one non-limiting embodiment, the independent air cells are arranged with wide ends adjacent to the narrow ends. In one non-limiting embodiment, the pumping assembly further comprises an odd independent pipeline connecting the pump with the independent air cells at odd positions of the air cell row, and an even independent pipeline connecting the pump with the independent air cells at even positions of the air cell row. In one non-limiting embodiment, the independent deflating unit comprises an odd solenoid valve and an even solenoid valve and has a deflating opening to the exterior, so that the independent air cells are selectively deflated independently via the odd and even solenoid valves, the odd independent pipeline is connected to the odd body pipeline via the odd independent solenoid valve, and the even independent pipeline is connected to the even body pipeline via the even independent solenoid valve, and the pumping assembly comprises a body alternating-valve connected between the pump with the body pipelines and the independent pipelines. In one non-limiting embodiment, the independent deflating unit comprises an odd solenoid valve and an even solenoid valve, having a deflating opening to the exterior, so that the independent air cells are deflatable independently via the odd and even solenoid valves, wherein the odd independent pipeline is connected to the odd body pipeline via the odd independent solenoid valve, and the even independent pipeline is connected to the even body pipeline via the even independent solenoid valve. In one non-limiting embodiment, the independent deflating unit comprises a manual alternating device connected between the body pipelines and the independent pipelines. In one non-limiting embodiment, the independent deflating unit comprises a manual alternating device connected between the body pipelines and the independent pipelines, and in that the pumping assembly further comprises a body alternating-valve connected between the pump with the body pipelines and the independent pipelines, a first check valve connected between the odd body pipeline and the odd head air cells, and a second check valve connected between the even body pipeline and the even head air cells. In one non-limiting embodiment, at least one offset air cell is mounted longitudinally on one side of the mattress body and enlarges the bearing surface of the medical air mattress and/or supports the upper bedspread. In one non-limiting embodiment, the offset air cell is connected to the pipeline connecting to the body air cells and/or to the head air cells, preferably protected by the check valves. In one non-limiting embodiment, there is provided a method to inflate/deflate a medical air mattress, preferably a medical air mattress wherein the mattress comprises a lower bedspread, a mattress body mounted on the lower bedspread with multiple body air cells and, preferably, multiple head air cells, substantially parallel to each other and arranged in a row forming an air cell row, a pumping assembly with a pump and at least a pipeline connecting the pump with the air cells, characterized in that the air cells are inflated and/or deflated selectively. In one non-limiting embodiment, there is provided a method to incline the bearing surface of a medical air mattress, wherein the medical air mattress comprises a lower bedspread, a mattress body mounted on the lower bedspread with multiple air cells arranged in a row forming an air cell row, wherein even air cells are on even positions of the air cell row and odd air cells on odd positions of the air cell row, and the air cells are gradually tapered in diameter from a wide end to a narrow end, the air cells being arranged with wide ends adjacent to the narrow ends, characterized in that the even and/or odd air cells are inflated and/or deflated separately, such that either all even or all odd air cells are inflated or deflated. In one non-limiting embodiment, there is provided a method wherein the inflating/deflating of selectively chosen air cells is performed by a one-hand operation, preferably by operating a control device with at least one one-touch button controlling the inflation/deflation. In one non-limiting embodiment, there is provided a method wherein at least three inclination angles are achievable by selectively inflating and/or deflating inclination providing air cells and/or even body cells and/or odd body cells and/or even and odd body cells. In one non-limiting embodiment, there is provided a method to generate in a medical air mattress a position for receiving a container, preferably a toilet bedpan, wherein the mattress comprises a lower bedspread, a mattress body mounted on the lower bedspread with multiple body air cells and, preferably, multiple head air cells, substantially parallel to each other and arranged in a row forming an air cell row, a pumping assembly with a pump and at least a pipeline connecting the pump with the air cells, characterized in that the air cells are inflated and/or deflated independently, such that independent air cells arranged at a central part in the air cell row being independently connected to the pumping assembly are deflated to create a substantially concave position in the central part of the mattress body.

Other objectives, advantages and novel features of the invention will become more apparent from the following detailed description, when reviewed in conjunction with the accompanying drawing.

The above-mentioned components to be used according to the invention, as well as those claimed and described in the examples of embodiments, are not subject in size, shaping, material selection and technical conception to any special exceptional conditions, so that the selection criteria known in the field of application can be applied without restriction.

Additional details, characteristics and advantages of the invention result from the sub claims as well as from the description below of the associated drawing in which, for the sake of example, several embodiments according to the invention are illustrated. Shown in the drawing are:

DETAILED DESCRIPTION OF THE DRAWINGS

Figure 1A:
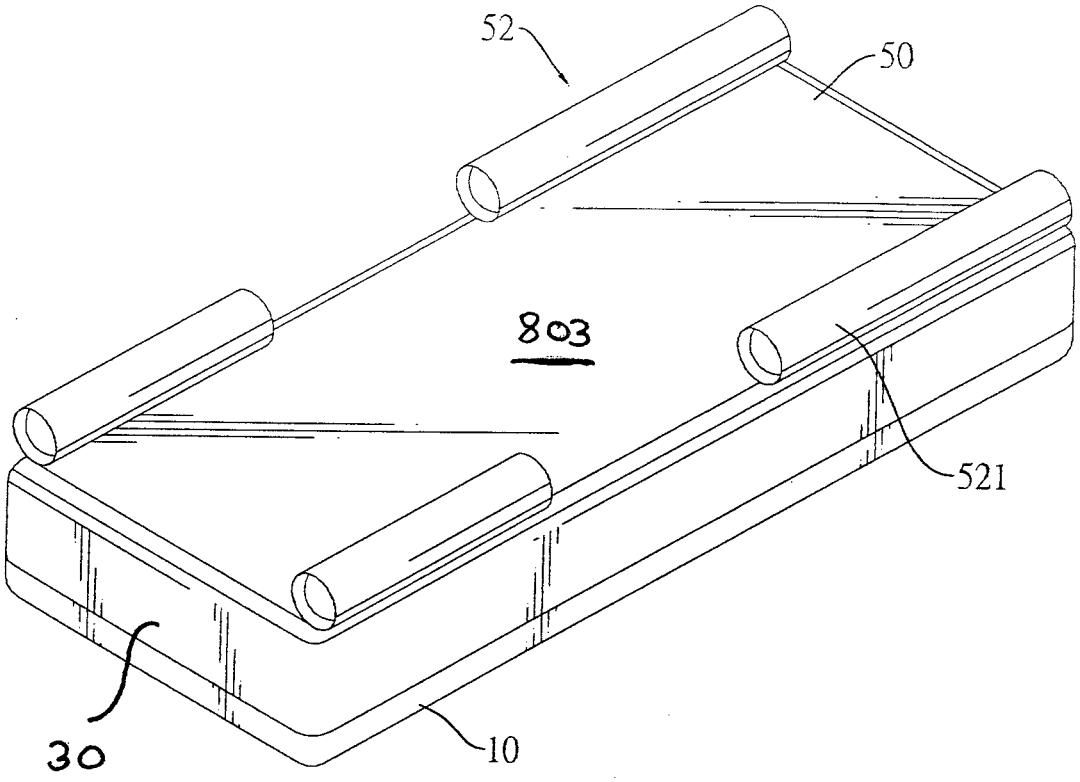
FIG. 1A a perspective view of a medical air mattress in accordance with the present invention.
Figure 1B:
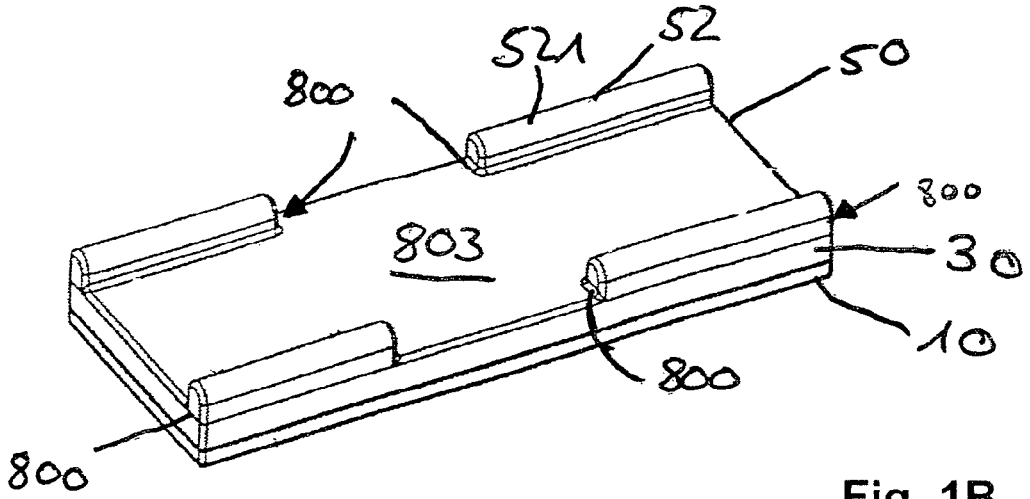
FIG. 1B a perspective view of a medical air mattress with guardrail sleeves comprising a flat base connected to the upper bedspread.

With reference to FIG. 1A, a first embodiment of a medical air mattress in accordance with the present invention comprises a lower bedspread 10, a mattress body 30, an upper bedspread 50 and a guardrail unit (60), with two guardrail sleeves 52 mounted on each longitudinal side of the upper bedspread 50. According to FIGS. 1B and 1C each guardrail sleeve 52 comprises two sleeve bodies 521 fixedly stitched with two lines or a double line to the upper bedspread 50. FIG. 1B shows the medical air mattress in perspective view and FIG. 1C shows a schematic picture of a medical air mattress with inclination to the right side of the patient 801 lying on the bearing surface 803 of the medical air mattress.

Figure 1C:
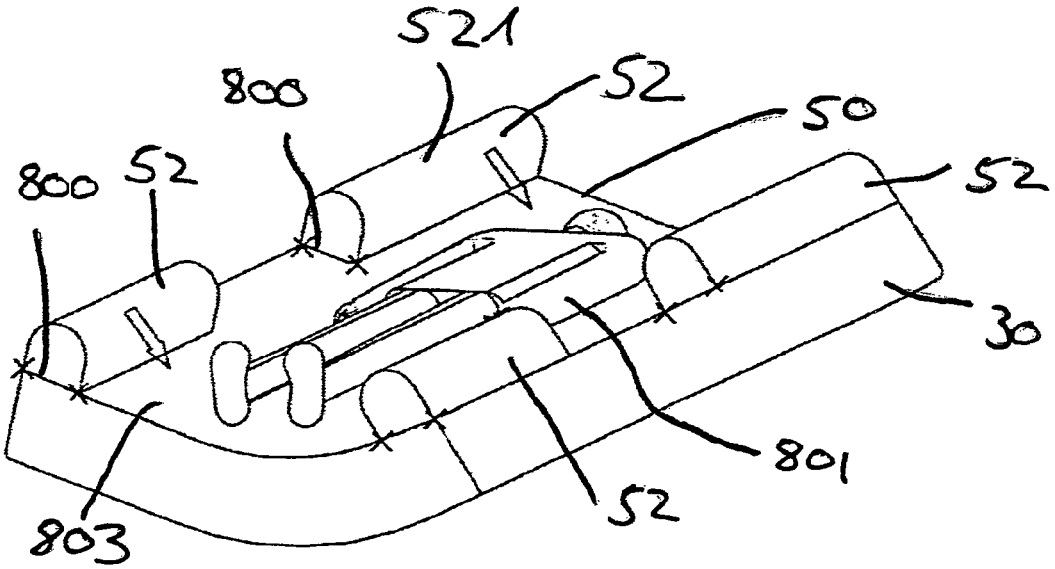
FIG. 1C a perspective view of a medical air mattress, the surface of the mattress being inclined on one longitudinal side of the mattress body.

Each sleeve body 521 of the guardrail according to FIGS. 1B and 1C has a flat base 800 which is fixed to the top cover of the—preferably alternating—air mattress in order to firmly hold the sleeves on the upper bedspread. The mounting of the sleeve 52 or the sleeve bodies 521 especially by stitching them to the bedspread 50 is such, that causing air leakage in the guardrail air cells 61 and/or the body air cells 31, 32 is avoided, also in case of mechanically stressing or straining the guardrail unit (60), e. g. by the patient 801. The safety of the patient 801 and the handling of the mattress will so be optimized.

Figure 2A:
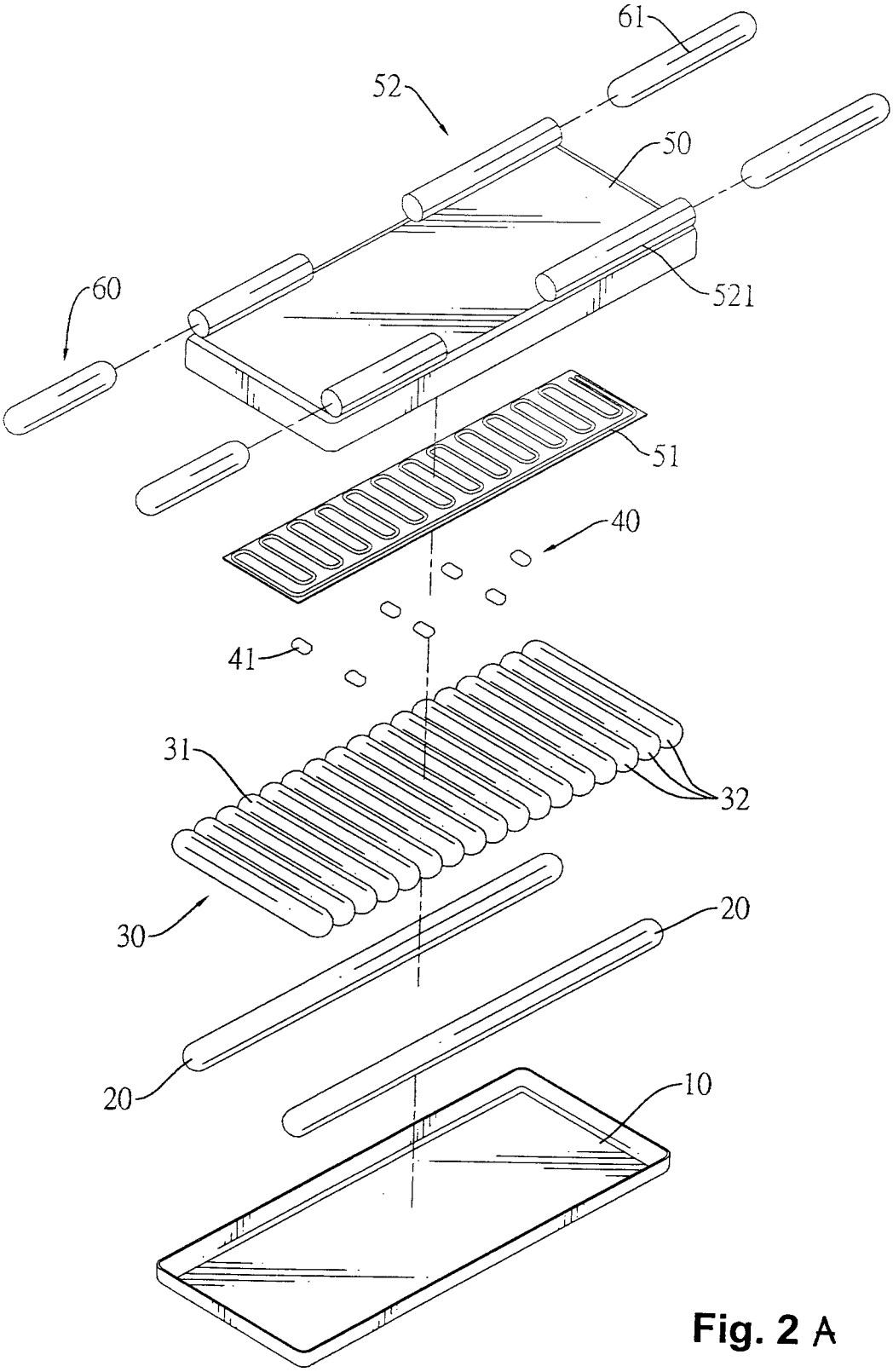
FIG. 2A an exploded perspective view of the medical air mattress according to FIG. 1.

According to FIG. 2A the mattress body 30 is mounted on the lower bedspread 10 comprising of multiple body air cells 31 and multiple head air cells 32. In a preferred embodiment, the mattress body 30 comprises three head air cells 32. Each body air cell 31 and each head air cell 32 are tubular and respectively uniform in diameter. The head air cells 32 have the same diameter with the body air cells 31. The body air cells 31 and the head air cells 32 are parallel to each other and are arranged in a row forming an air cell row. The head air cells 32 are arranged at a head end in the air cell row, i.e. the head air cells 32 arranged at first to third in the air cell row. The body air cells 31 are arranged at fourth to seventeenth in the air cell row.

The upper bedspread 50 covers the mattress body 30 and is connected securely to the lower bedspread 10. A heat unit 51 is installed preferably under the upper bedspread 50 and above mattress body 30 for heating. The heat unit 51 may be a carbon fiber electro thermal sheet. The upper bedspread 50 has guardrail sleeves 52. The guardrail sleeves 52 are formed parallel on both longitudinal sides of the upper bedspread 50 and are respectively formed adjacent to the edges of both (longitudinal) sides of the upper bedspread 50. In a preferred embodiment, the guardrail sleeves 52 are stitched on the upper bedspread 50. Each guardrail sleeve 52 has at least one sleeve body 521. In a preferred embodiment, each guardrail sleeve 52 has two sleeve bodies 521 formed separately and aligning with and coaxial to each other.

Further referring to FIG. 2A the guardrail air unit 60 is mounted in the guardrail sleeves 52 and comprises multiple guardrail air cells 61. The guardrail air cells 61 are mounted respectively in the sleeve bodies 521 of the guardrail sleeve 52.

Figure 2B:
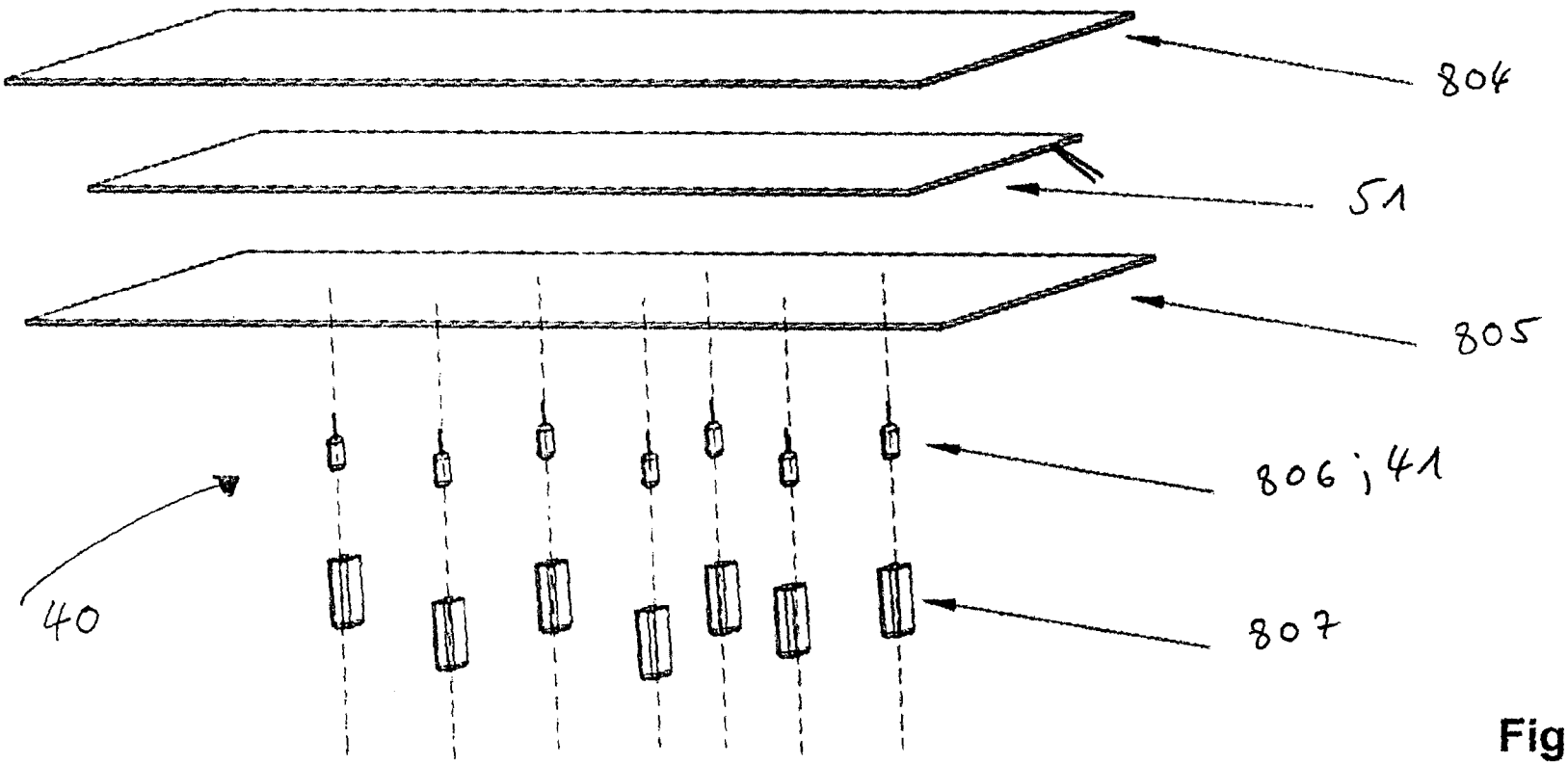
FIG. 2B an exploded perspective view of a massage and heater unit of the medical air mattress according to FIG. 2A.

According to FIG. 2B the medical air mattress further comprises a massage unit 40 mounted on or in the mattress body 30 (see also FIG. 2A). The massage unit 40 according to FIG. 2B comprises multiple vibrator units 806 or micro vibrators 41 respectively in order to massage the patients 801 lying on the bearing surface 803 of the medical air mattress as described. Those micro vibrators 806, 41 distribute massage separately and respectively to patient's neck, back, waist, thighs and so on. The massage unit 40 may further comprise a first layer 804 and a second layer 805. Each layer 804, 805 can be made of a material, which is waterproof or nearly waterproof. Below the first layer 804 and/or the second layer 805 the second layer 805 multiple vibrator units 806 are positioned. Each vibrator unit 806 can be placed in a vibrator unit holding bag 807. According to a preferred embodiment in or above the massage unit a heating element 51 can be placed between both layers 804, 805. The heating element 51 can comprise a carbon material. Alternatively the heat unit 51 can be positioned on or in the mattress body 30 separately, that is to say e. g. without a massage unit 40.

Figure 3A:
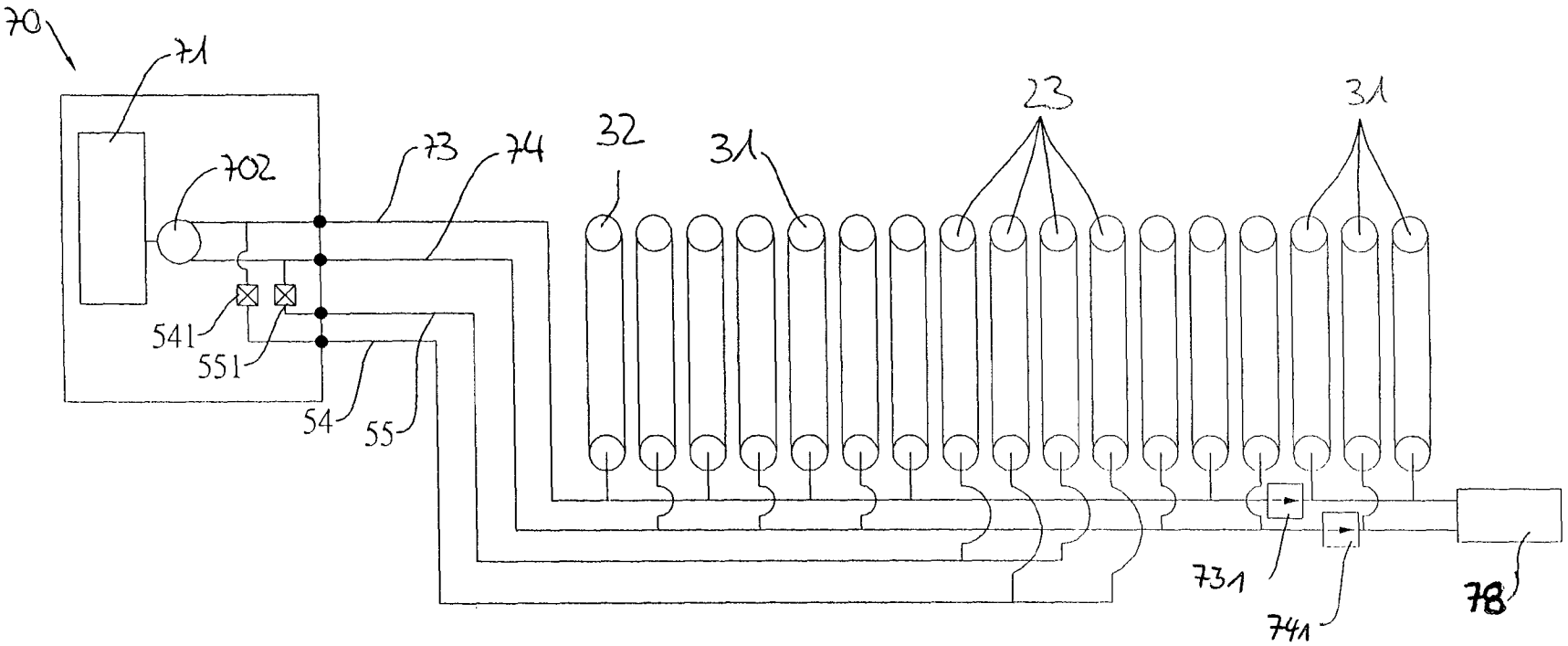
FIG. 3A-D pipeline diagrams of different embodiments of the medical air mattress.

With reference to FIG. 3A, the medical air mattress as described comprises a pumping assembly 70. The pumping assembly 70 is connected to and selectively inflates the body air cells 31, the head air cells 32 and independent air cells 23. According to a preferred embodiment and with reference to FIG. 9A the independent air cells can be conically shaped, so that each independent air cell gradually tapers in diameter from one end to the other end, so that each body air cell and each independent air cell has a wide end and a narrow end.

Preferably the pumping assembly 70 comprises a pump 71, an odd body pipeline 73, an even body pipeline 74, an odd independent pipeline 54, an even independent pipeline 55 and a rapidly releasing valve 78, as shown in FIG. 3A. The odd body pipeline 73 connects the pump 71 with the odd body air cells 31 and the head air cells 32 at odd rows of the air cell rows. An even (odd) row means a row at an even (odd) position of the air cell row. The even body pipeline 74 connects the pump 71 with the even body air cells 31 and the head air cells 32 at even rows of the air cell rows. The odd independent pipeline 54 connects the pump 71 with the independent air cells 23 at odd rows of the air cell rows. The even independent pipeline 55 connects the pump 71 with the independent air cells 23 at even rows of the air cell rows. The rapidly releasing valve 78 is connected to the odd body pipeline 73 and the even body pipeline 74 for rapidly releasing the air in the mattress body 30 for emergency use. For example, when the patient needs cardiopulmonary resuscitation (C.P.R.), the medical air mattress as described needs not be removed or the patient needs not be moved since the mattress body 30 is rapidly deflated to rescue the patient immediately. This contributes to the improvement of the handling of the medical air mattress.

According to FIG. 3A the pump 71 is connected to a body alternating-valve 702. The body alternating-valve 702 is connected between the pump 71 and the body pipelines 73, 74 and the independent pipelines 54, 55. The independent air cells 23 are connected to an independent deflating unit to be deflated independently. The independent deflating unit comprises an odd solenoid valve 541 and an even solenoid valve 551. The odd and even solenoid valves 541, 551 are three-way valves and respectively have deflating opening to the exterior so that the independent air cells 23 are selectively deflated independently via the odd and even solenoid valves 541, 551. The odd independent pipeline 54 is connected to the pump 71 via the odd body pipeline 73. The even independent pipeline 55 is connected to the pump 71 via the even body pipeline 74. In a preferred embodiment, the odd independent pipeline 54 is connected to the odd body pipeline 73 via the odd independent solenoid valve 541, and the even independent pipeline 55 is connected to the even body pipeline 74 via the even independent solenoid valve 551. The odd body pipeline 73 is connected to the head air cells 32 via a first check valve 731. The even body pipeline 74 is connected to the head air cells 32 via a second check valve 741.

Figure 3B:
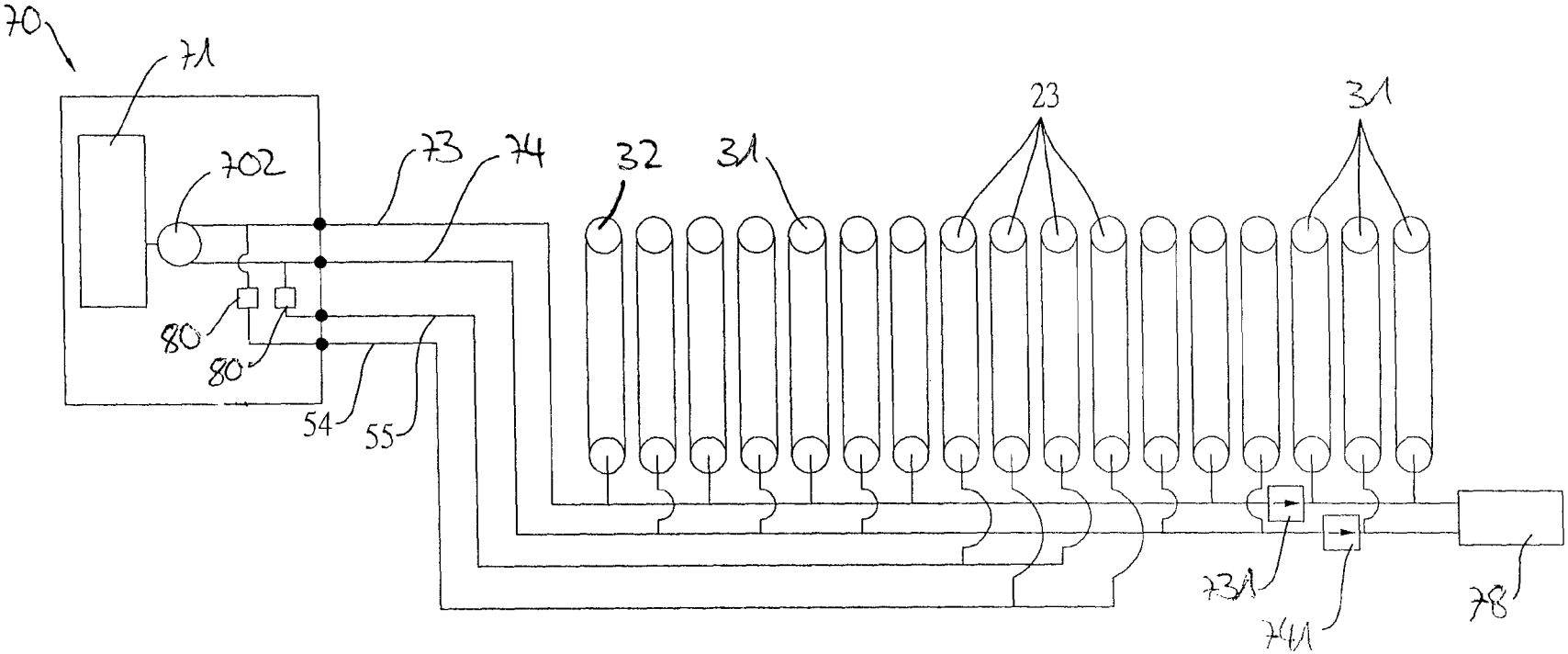

With reference to FIG. 3B, the independent deflating unit for the independent air cells 23 may be a manual alternating device 80. The user controls the manual alternating device 80 to stop inflating the independent air cells 23. The manual alternating device 80 has an air inlet, an inflating opening, a deflating opening, a linking rod, two airflow washers, an air restricting washer and a resilient element. The air inlet is connected to the body alternating-valve 702. The inflating opening is connected to the independent air cells 23 through the independent pipelines 54, 55. The deflating opening communicates with the exterior. When inflating, the deflating opening is closed and the inflating opening is opened to inflate the independent air cells 23. When deflating, the resilient element, the linking rod and the air restricting washer are manually moved to close the inflating opening and to open the deflating opening. Then the independent air cells 23 are deflated independently.

Figure 11A:
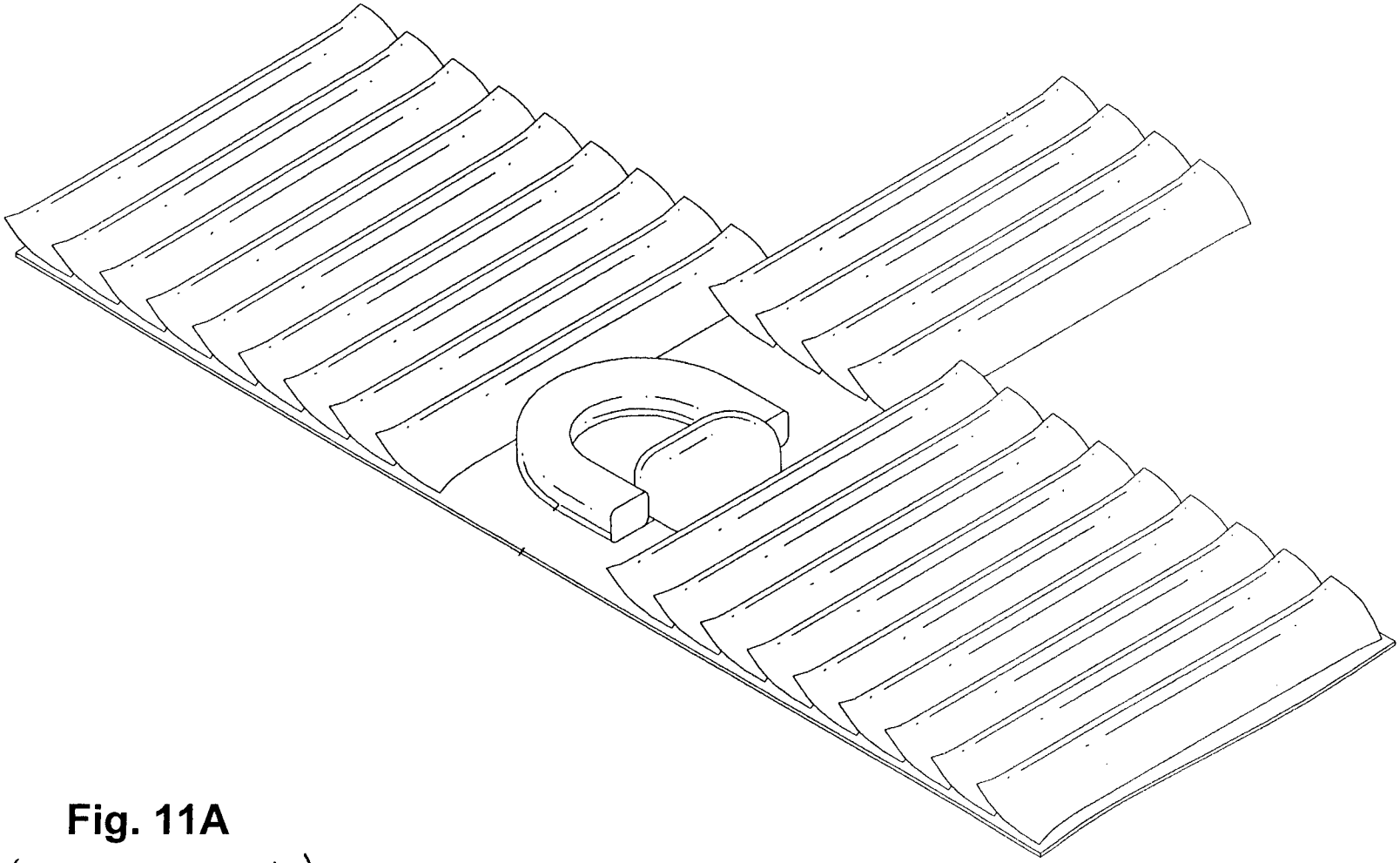
FIG. 11A a perspective view a medical air mattress with a removable center portion according to the state of the art.

Thus according to the invention sanitation aspects of the medical air mattress become improved, so that the air mattress can be better handled. It is no longer necessary to remove the top cover of the mattress in order to get access to a removable part of the mattress, e. g. like it can be seen in the state of the art according to FIG. 11A.

Figure 3C:
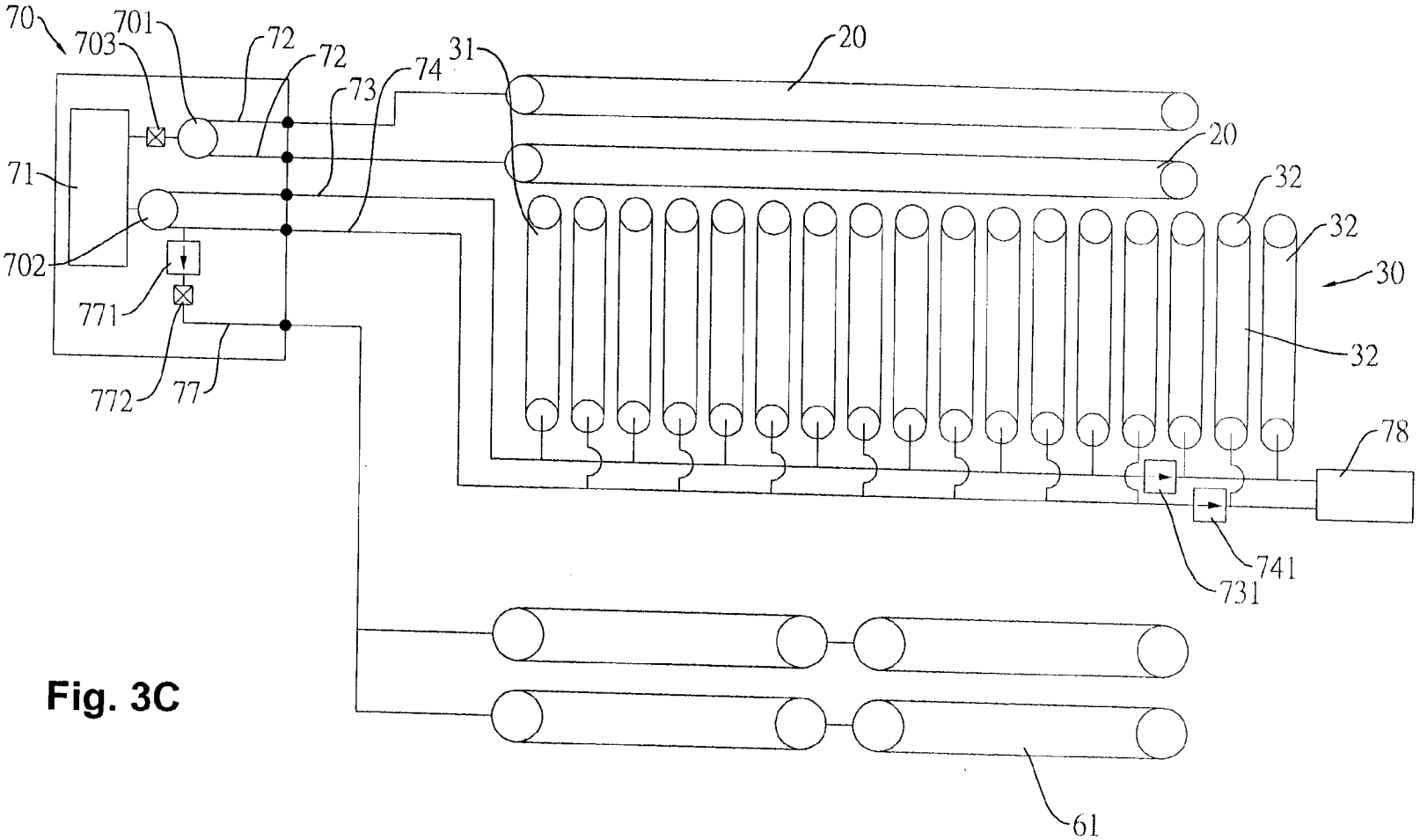

With reference to FIG. 3C, the medical air mattress as described comprises a pumping assembly 70. The pumping assembly 70 is connected to and selectively inflates the inclination providing air cells 20, the body air cells 31, the head air cells 32 and the guardrail air cells 61. In a preferred embodiment, the pumping assembly 70 comprises a pump 71, an inclination providing pipeline 72, an odd body pipeline 73, an even body pipeline 74, a guardrail pipeline 77 and a rapidly releasing valve 78. The inclination providing pipeline 72 connects the pump 71 with the inclination providing air cells 20. The odd body pipeline 73 connects the pump 71 with the body air cells 31 and the head air cells 32 at odd positions of the air cell rows. The even body pipeline 74 connects the pump 71 with the body air cells 31 and the head air cells 32 at even positions of the air cell rows. The guardrail pipeline 77 connects the pump 71 with the guardrail air cells 61. The rapidly releasing valve 78 is connected to the odd body pipeline 73 and the even body pipeline 74 for rapidly releasing the air in the mattress body 30 for emergency uses. For example, when the patient needs C.P.R., the medical air mattress and the guard rail assembly as described needs not be removed or the patient needs not be moved since the mattress body 30 and the guardrail assembly is rapidly deflated to rescue the patient immediately.

According to FIG. 3C the pump 71 is connected to an inclination providing alternating-valve 701 and a body alternating-valve 702. An inclination providing solenoid valve 703 is also connected between the inclination providing alternating-valve 701 and the pump 71. The inclination providing alternating-valve 701 is connected between the inclination providing solenoid valve 703 and the inclination providing pipeline 72. The body alternating-valve 702 is connected between the pump 71 with the body pipelines 73, 74 and the guardrail pipeline 77. The guardrail pipeline 77 is connected to the body alternating-valve 702 via a guardrail solenoid valve 772. The odd body pipeline 73 is connected to the head air cells 32 via a check valve 731. The even body pipeline 74 is connected to the head air cells 32 via a check valve 741. The body alternating-valve 702 is connected to the guardrail solenoid valve 772 via a check valve 771.

Figure 3D:
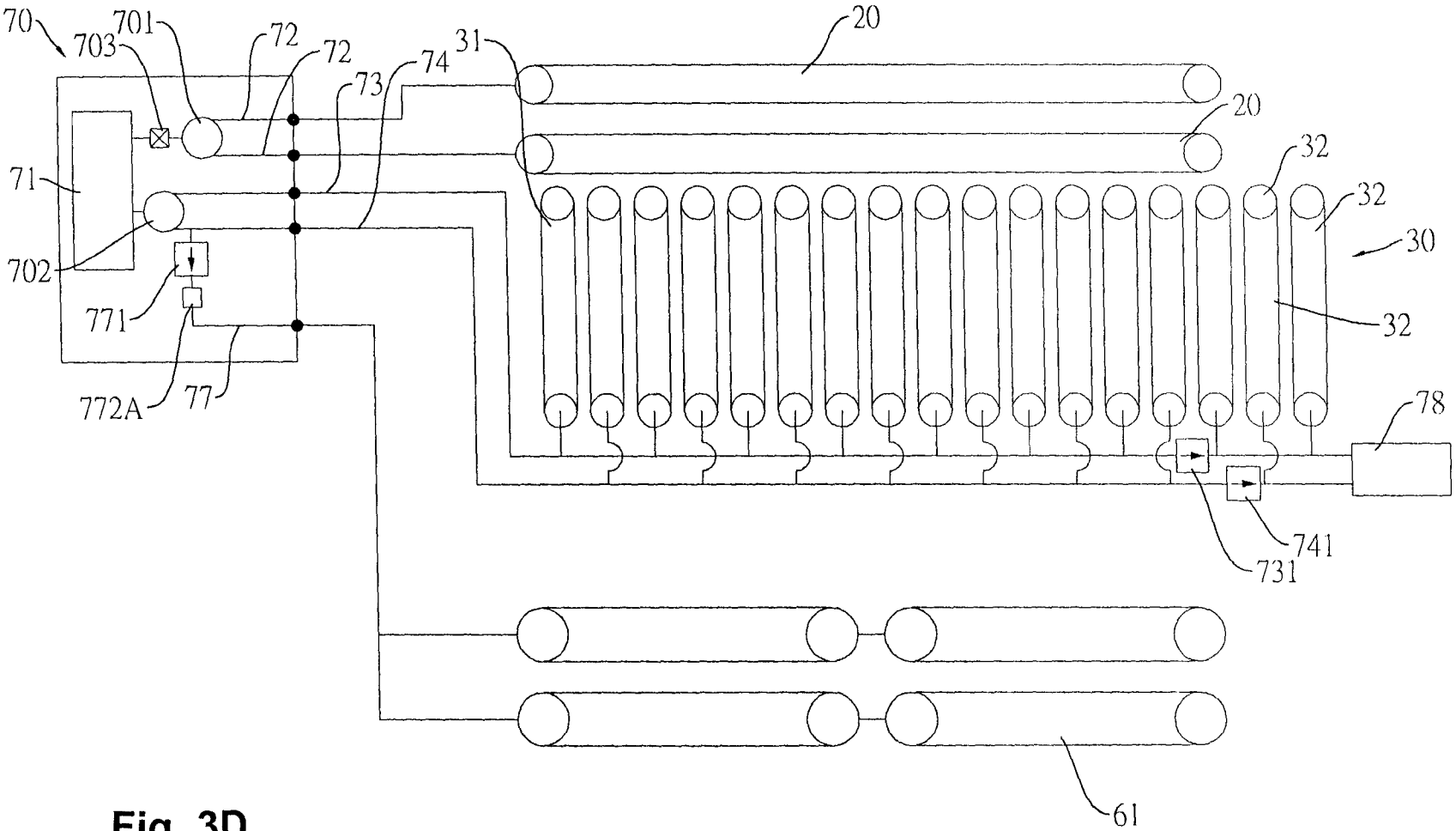

With reference to FIG. 3D, the deflating unit for the guardrail air cells 61 may be a manual alternating device 772A. The user controls the manual alternating device 772A to stop inflating the guardrail air cells 61. The manual alternating device 772A has an air inlet, an inflating opening, a deflating opening, a linking rod, one or more airflow washers, an air restricting washer and a resilient element. The air inlet is connected to the body alternating-valve 702. The inflating opening is connected to the guardrail air cells 61 through the guardrail pipeline 77. The deflating opening communicates with the exterior. When inflating, the deflating opening is closed and the inflating opening is opened to inflate the guardrail air cells 61. When deflating, the resilient element, the linking rod and the air-resisting washer are manually moved to close the inflating opening and to open the deflating opening. Then the guardrail air cells 61 are deflated independently.

When the medical air mattress as described in FIGS. 3A and 3B is operated, the pump 71, the alternating-valves 702 and the solenoid valves 541, 551 are actuated to inflate the air cells and to alternatively adjust the inflating. The inflating and the deflating operations are described detailed below.

For the mattress body according to FIGS. 3A and 3B, when the pump 71 is operated, user may select different modes.

Full inflating mode: With reference to FIGS. 3A and 3B, the pump 71 is operated to inflate the body air cells 31, the head air cells 32 and the independent air cells 23.

Figure 5:
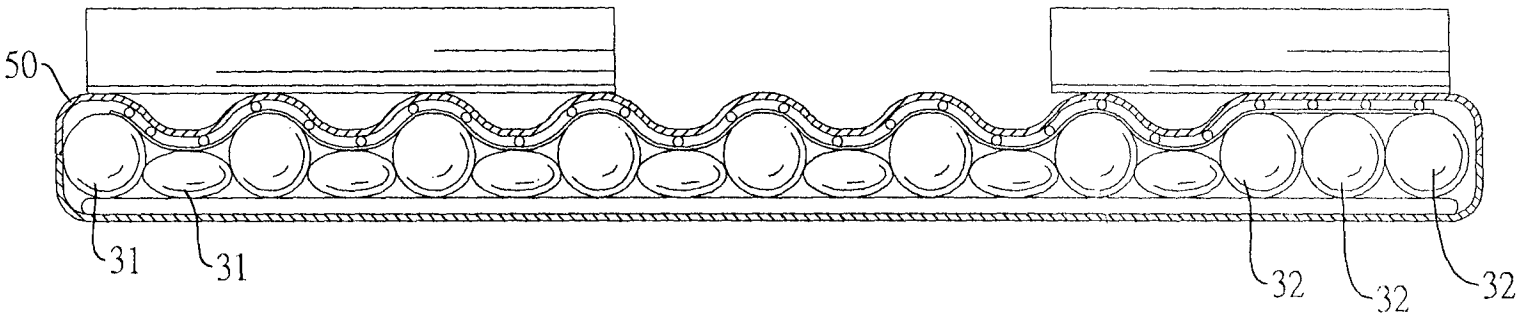
FIG. 5 an operational side view in partial section of a medical air mattress, showing the odd body air cells inflated.
Figure 6:
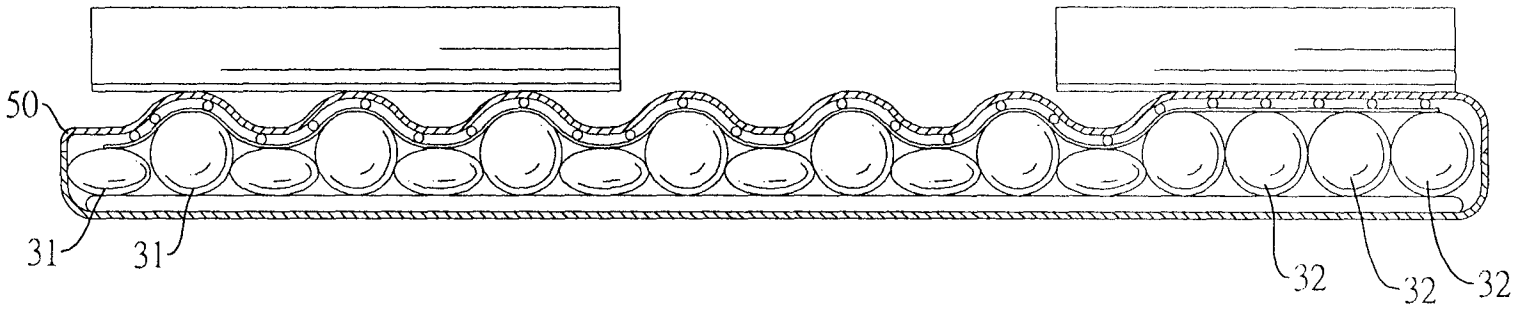
FIG. 6 an operational side view in partial section of a medical air mattress, showing the even body air cells inflated.

Alternating inflating mode: With reference to FIGS. 3A and 3B, the pump 71 is operated and inflates the body air cells 31 and the independent air cells 23 at odd or even rows of the air cell rows alternatively. In a preferred embodiment, the body alternating-valve 702 accomplishes the alternating inflating. The pump 71 supplies air into the body alternating-valve 702. The body alternating-valve 702 alternatively supplies air into the odd or even body pipelines 73, 74. When the odd body pipeline 73 is inflated, the body air cells 31 and the independent air cells 23 at odd rows of the air cell rows are in-flated and the body air cells 31 and the independent air cells 23 at even rows of the air cell rows are deflated as shown in FIG. 5. When the even body pipeline 74 is in-flated, the body air cells 31 and the independent air cells 23 at even positions of the air cell rows are inflated and the body air cells 31 and the independent air cells 23 at odd positions of the air cell rows are deflated as shown in FIG. 6. Moreover, since the check valves 731, 741 are connected between the head air cells 32, the odd and even body pipelines 73, 74, the head air cells 32 are kept inflated without deflating by the body alternating-valve 702 to support the patient's head stably.

For the independent air cells 23 as shown in FIGS. 3A and 3B, the user may stop inflating the independent air cells 23 independently. In a preferred embodiment, the odd solenoid valve 541 and the even solenoid valve 551 are used to stop inflating the independent air cells 23. Each solenoid valve 541, 551 has an air inlet, an inflating opening and a deflating opening. The air inlet is connected to the body alternating-valve 702. The inflating opening is connected to the independent air cells 23 through the independent pipelines 54, 55. The deflating opening is connected to the exterior. When the independent air cells 23 are inflated, the deflating opening is closed and the inflating opening is opened. When the independent air cells 23 are deflated independently, the inflating opening is closed and the deflating opening is opened. The central part of the upper bedspread 50 corresponding to the independent air cells 23 is not supported when the independent air cells 23 are deflated. If required the central part of the upper bedspread 50 can be recessed to form space or place for receiving the bedpan. Therefore, the patient 801 lying on the bearing surface 803 of the medical air mattress as described does not have to move and can use the bedpan while lying on the medical air mattress as described.

When the medical air mattress as described in FIGS. 3C and 3D is operated, the pump 71, the alternating-valves and the solenoid valves are actuated to inflate the air cells and to adjust the inflating. The inflating and the deflating operations are described detailed below.

For guardrail air cells 61, when the pump 71 is operated, the guardrail air cells 61 are inflated to expand the guardrail sleeves 52 to provide side protections on the upper bedspread 50. When the patients 801 lying on the upper bedspread 50 accidentally press on the guardrail sleeves 52, the guardrail sleeves 52 on both sides are drawn by each other since the guardrail sleeves 52 are formed on both sides of the upper bedspread 50. The drawing force keeps the guardrail sleeves 52 maintaining their shapes even being pressed. Therefore, the guardrail sleeves 52 are kept in position to protect the patients lying on the medical air mattress as described. Further, the check valve 771 keeps the air from back flowing when the body alternating-valve 702 is operated.

For the mattress body according to the embodiment shown in FIGS. 3C and 3D, when the pump 71 is operated, user may select different modes.

Figure 4:
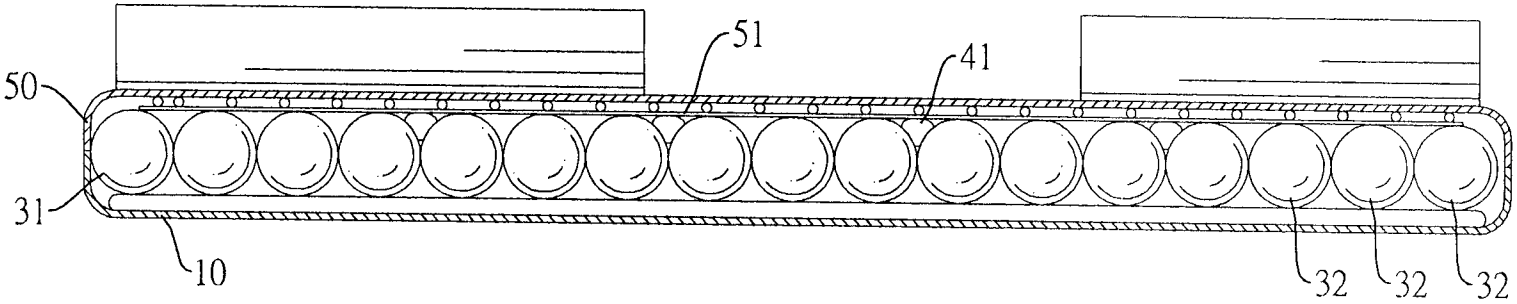
FIG. 4 an operational side view in partial section of the medical air mattress in FIG. 1, showing the body air cells all inflated.

Full inflating mode: With reference to FIGS. 3C and 3D, the pump 71 is operated to inflate the body air cells 31 and the head air cells 32. The condition where all air cells of the mattress body are inflated is shown in FIG. 4.

Alternating inflating mode: With reference to FIGS. 3C and 3D, the pump 71 is operated and inflates the body air cells 31 at odd or even rows of the air cell rows alternately. In a preferred embodiment, the body alternating-valve 702 accomplishes the alternating inflating. The pump 71 supplies air into the body alternating-valve 702. The body alternating-valve 702 alternately supplies air into odd or even body pipelines 73, 74. When the odd body pipeline 73 is inflated, the body air cells 31 at odd positions of the air cell rows are inflated and the body air cells 31 at even positions of the air cell rows are deflated as shown in FIG. 5. When the even body pipeline 74 is inflated, the body air cells 31 at even rows of the air cell rows are inflated and the body air cells 31 at odd rows of the air cell rows are deflated as shown in FIG. 6. Moreover, since the check valves 731, 741 are connected between the head air cells 32 with the odd and even body pipelines 73, 74, the head air cells 32 are kept inflated without deflating by the body alternating-valve 702 to support the patient's head stably.

Figure 7A:
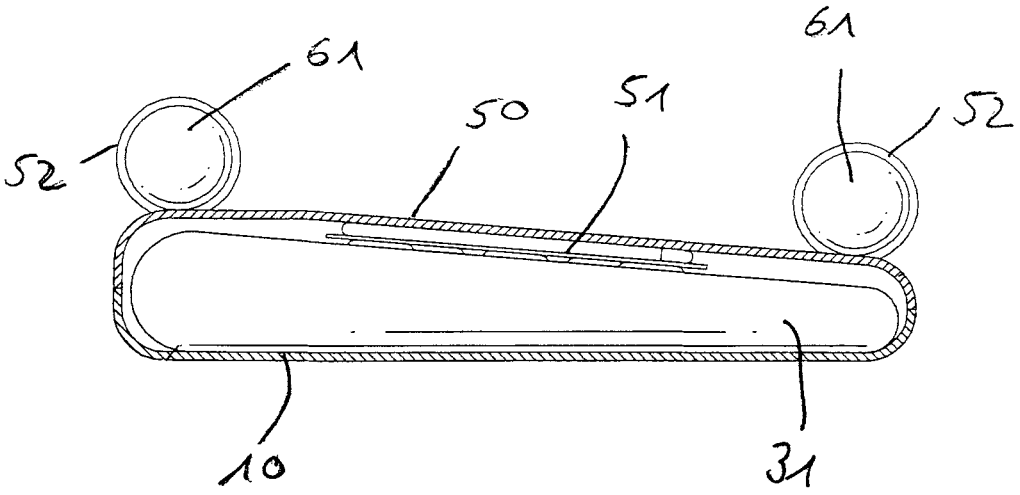
FIG. 7A/B an operational end view in partial section of a different embodiment of the medical air mattress, showing a body air cell being gradually tapered in diameter from a wide end to a narrow end.
Figure 7B:
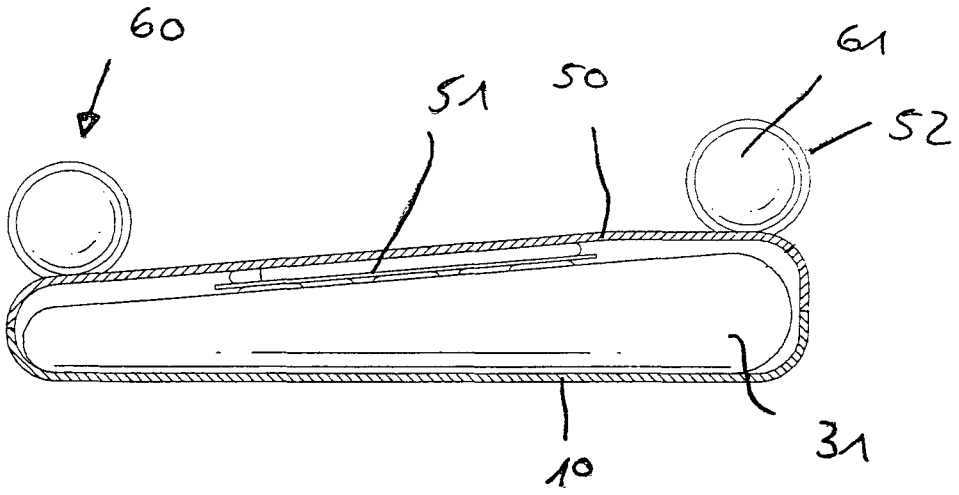
FIG. 7C an operational end view in partial section of a different embodiment of the medical air mattress with two inclination providing air cells, one of them being inflated.
Figure 7C:
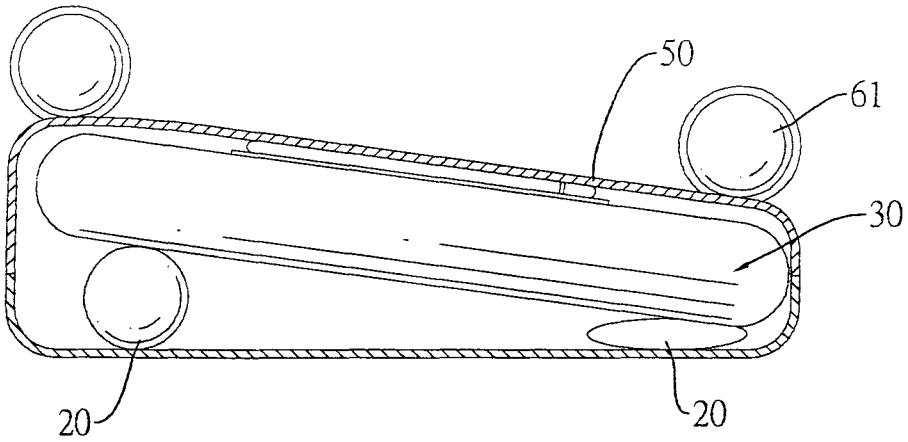

For the inclination providing air cells 20 as shown in FIGS. 3C and 7C, the pump 71 is operated to inflate one of the inclination providing air cells 20 to tilt one side of the medical air mattress as described so that the patient is to be turned over easily. In a preferred embodiment, the inclination providing alternating-valve 701 is operated to inflate the inclination providing air cells 20 alternately.

Figure 8:
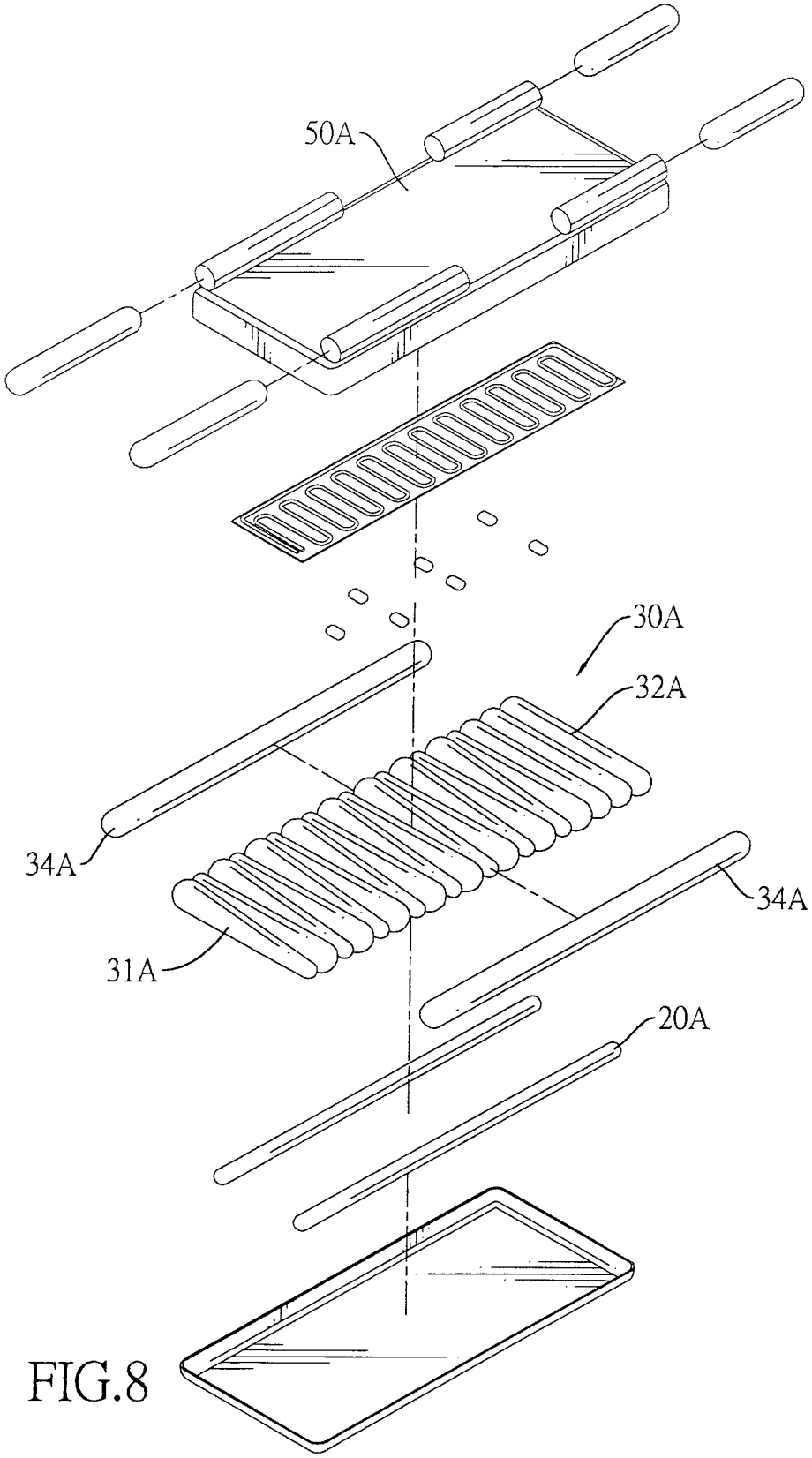
FIG. 8 an exploded perspective view of another embodiment of a medical air mattress.
Figure 9A:
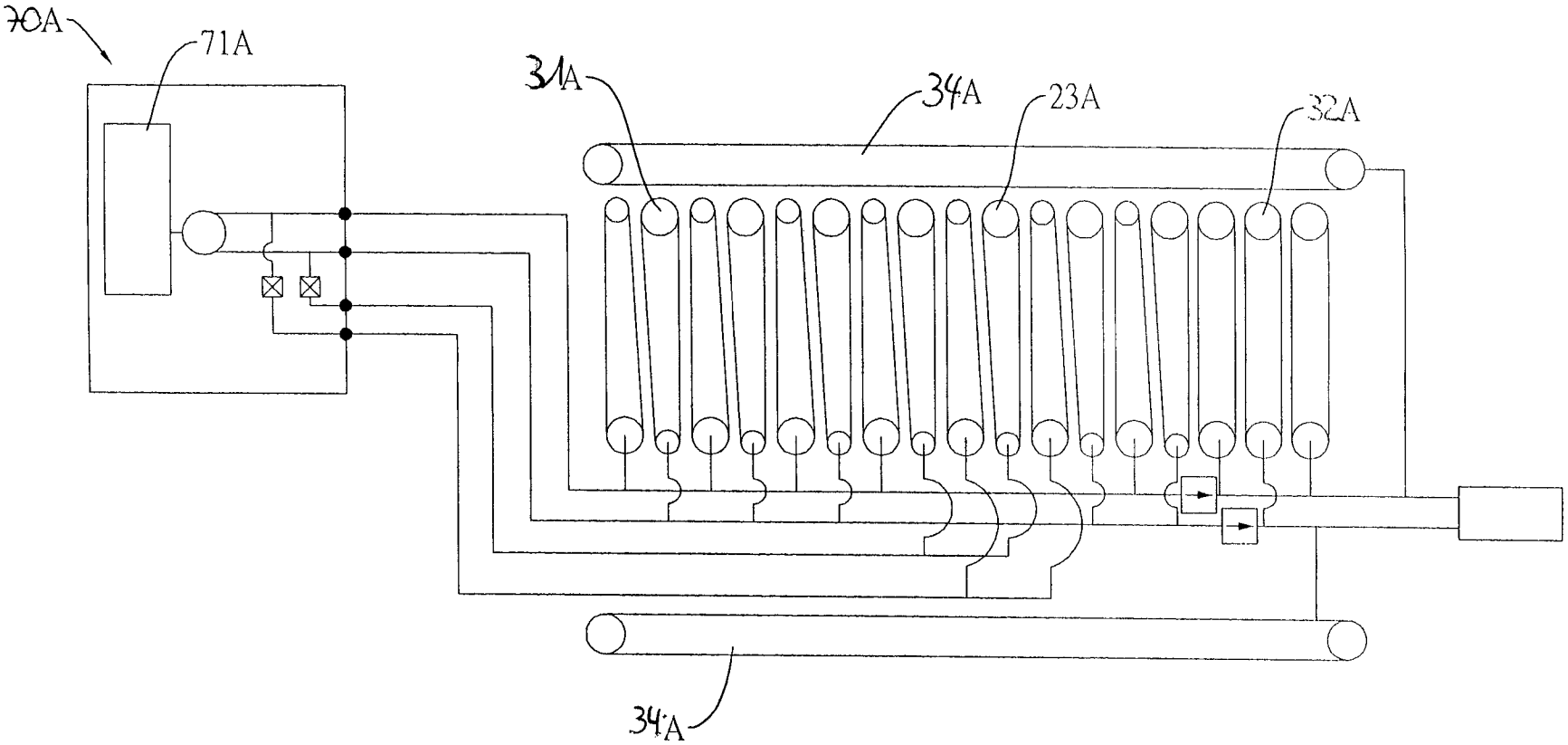
FIG. 9A/B a pipeline diagram of different embodiments of the medical air mattress.
Figure 9B:
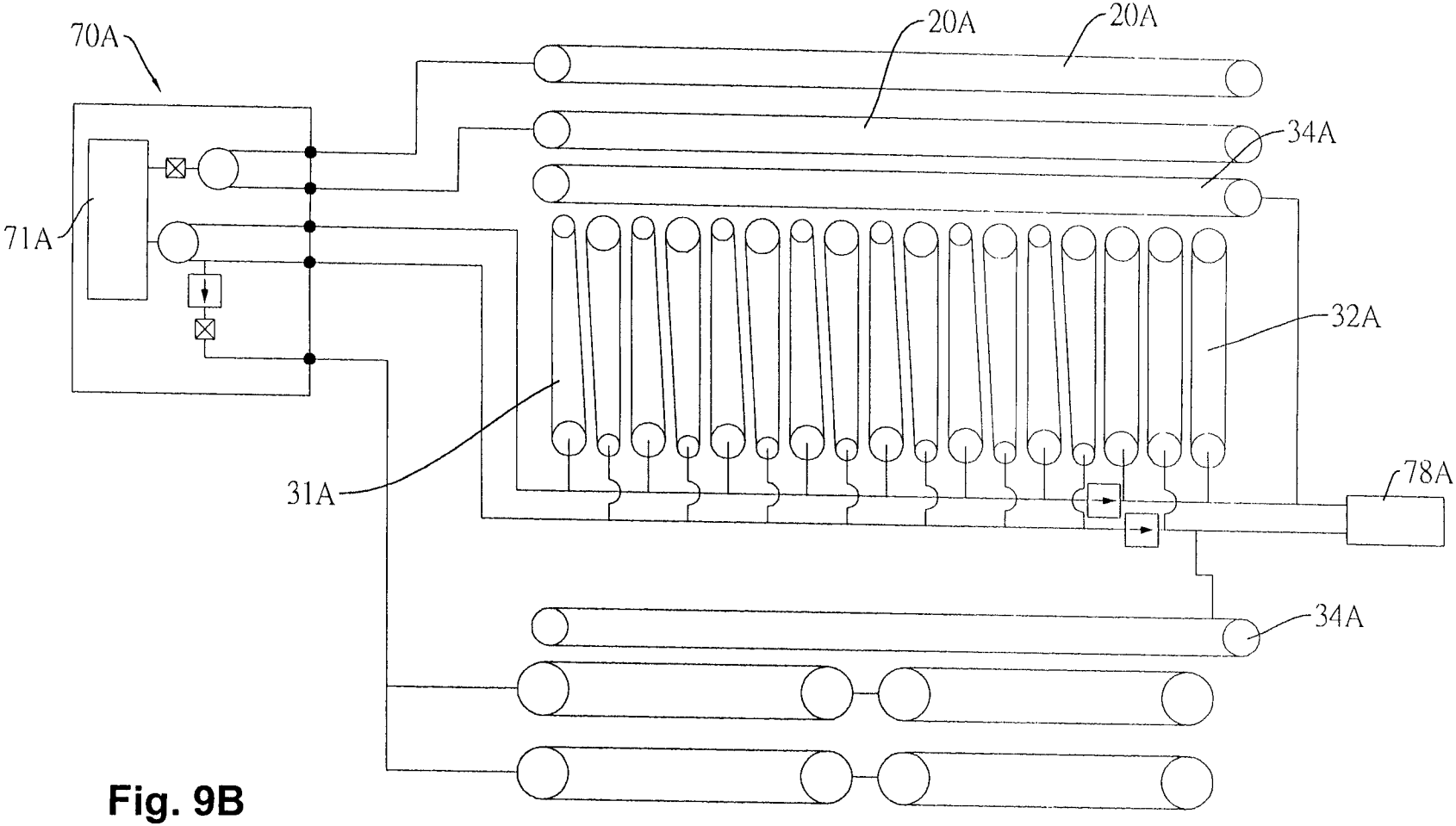

With reference to FIGS. 8, 9A and 9B, a second embodiment of a medical air mattress in accordance with the present invention is described. The body air cells 31A of the body mattress 30A according to FIG. 8 are conical. An end view of the air mattress with conical mattress bodies is shown in FIGS. 7A and 7B. Each body air cell 31A gradually tapers in diameter from one end to the other end so that each body air cell 31A has a wide end and a narrow end. The body air cells 31A are arranged with wide ends adjacent to the narrow ends. For example, the wide ends of the body air cells 31A at odd positions of the air cell rows align with the narrow ends of the body air cells 31A at even positions of the air cell rows. The medical air mattress as described further comprises two offset air cells 34A mounted longitudinally and mounted respectively on two sides of the mattress body 30A to enlarge the area of the medical air mattress and to support the upper bedspread 50A. The offset air cells 34A are connected to the pipeline connecting to the head air cells 32A and are also protected by the check valves 731, 741 to maintain inflating.

When the medical air mattress as described in FIG. 8 is operated, the pump 71A, the alternating-valves and the solenoid valves are also actuated to inflate the air cells and to alternatively adjust the inflating. Since most operations are discussed above, only different operations are described below for the embodiment of the medical air mattress according to FIG. 8. For mattress body 30A, when the pump 71A is operated, user may select different modes.

Full inflating mode: The pump 71A is operated to inflate all the body air cells 31A and the head air cells 32A.

Figure 10A:
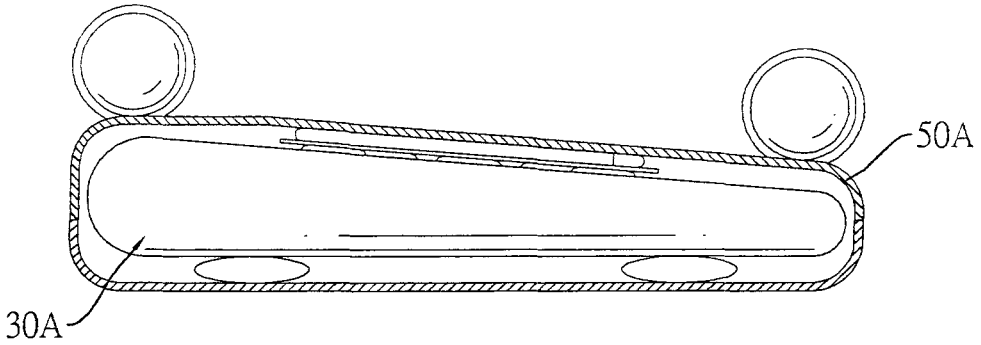
FIG. 10A-E an operational end view in partial section of the medical air mattress, showing different air cells inflated.
Figure 10B:
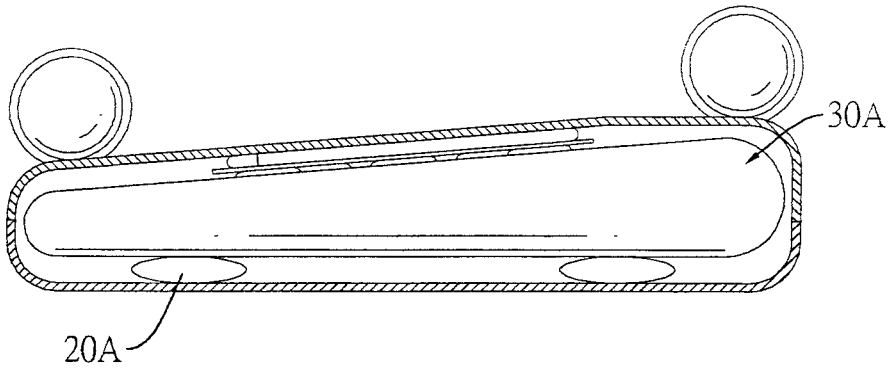
Figure 10C:
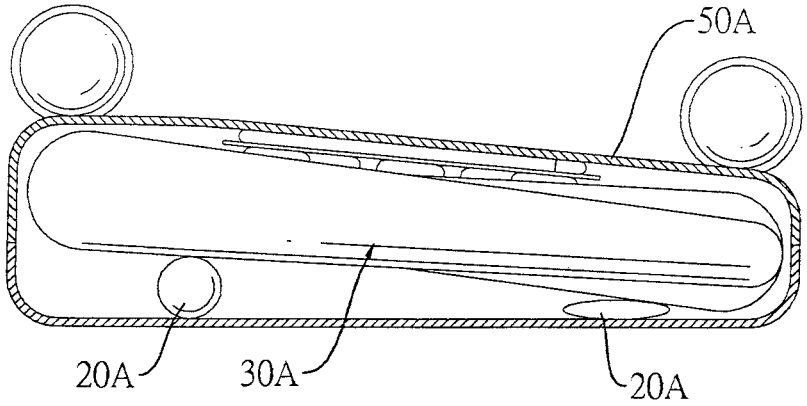
Figure 10D:
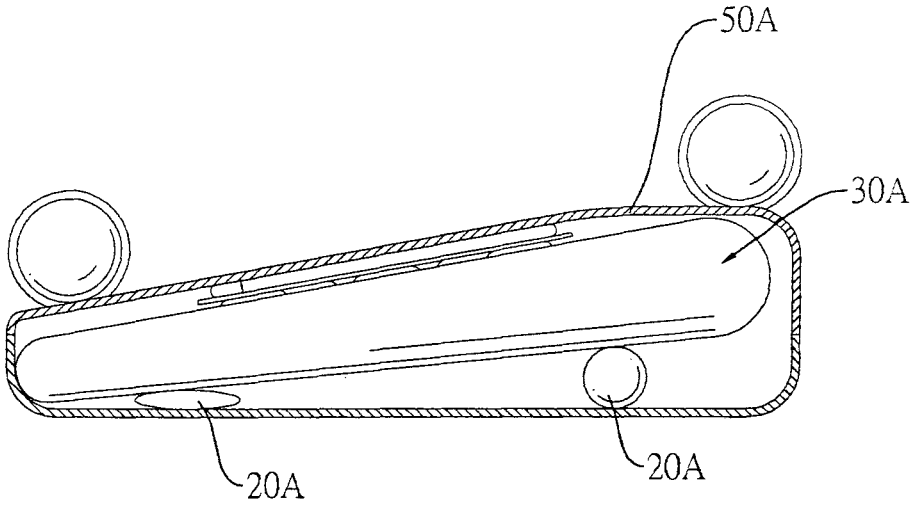
Figure 10E:
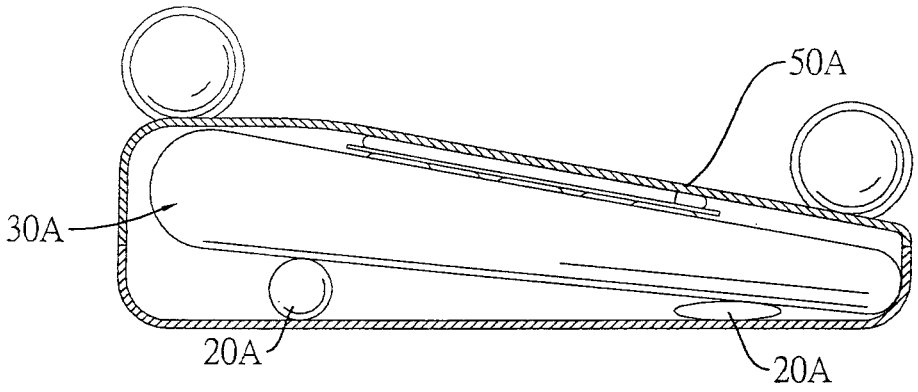

Alternating inflating mode: With reference to FIGS. 9A, 9B and 10A to 10F, the pump 71A is operated and inflates the body air cells 31A at odd or even rows of the air cell rows alternatively. When the body air cells 31A at odd rows of the air cell rows are inflated, the body air cells 31A at even rows of the air cell rows are deflated as shown in FIG. 10A. Since the body air cells 31A at odd positions of the air cell rows have wide left ends and narrow right ends, the mattress body 30A is higher at left side and lower at right side to tilt the patient rightward. When the body air cells 31A at even rows of the air cell rows are inflated, the body air cells 31A at odd rows of the air cell rows are deflated as shown in FIG. 10B. Since the body air cells 31A at even positions of the air cell rows have wide right ends and narrow left ends, the mattress body 30A is higher at right side and lower at left side to tilt the patient leftward. Therefore, the alternating inflating of the body air cells 31A not only provides the alternative wave of the mattress body 30A, but also tilts the patient at certain inclination angle. In this embodiment, the body air cells 31A provides inclination angle at, said 10 degrees or nearly 10 degrees. "Nearly" in this connection means, that the inclination angle may be a few degrees smaller or larger than the given angle.

With reference to FIGS. 9A, 9B and 10C to 10E, the alternating inflating of the body air cells 31A associated with the inclination providing air cells 20A provides more different inclination angles.

When all of the body air cells 31A are inflated and one of the inclination providing air cells 20A is inflated as shown in FIG. 12, the top surface of the upper bedspread 50A is tilted to one side to provide an inclination angle at, said 20 degrees or nearly 20 degrees.

When the body air cells 31A at even positions of the air cell rows are inflated and the body air cells 31A at odd positions of the air cell rows are deflated, the inclination providing air cell 20A at right side is also simultaneously inflated to provide a totally added inclination angle at, said 30 degrees or nearly 30 degrees.

When the body air cells 31A at odd rows of the air cell rows are inflated and the body air cells 31A at even positions of the air cell rows are deflated, the inclination providing air cell 20A at left side is also inflated to provide an inclination angle at, said 30 degrees or nearly 30 degrees.

Figure 10F:
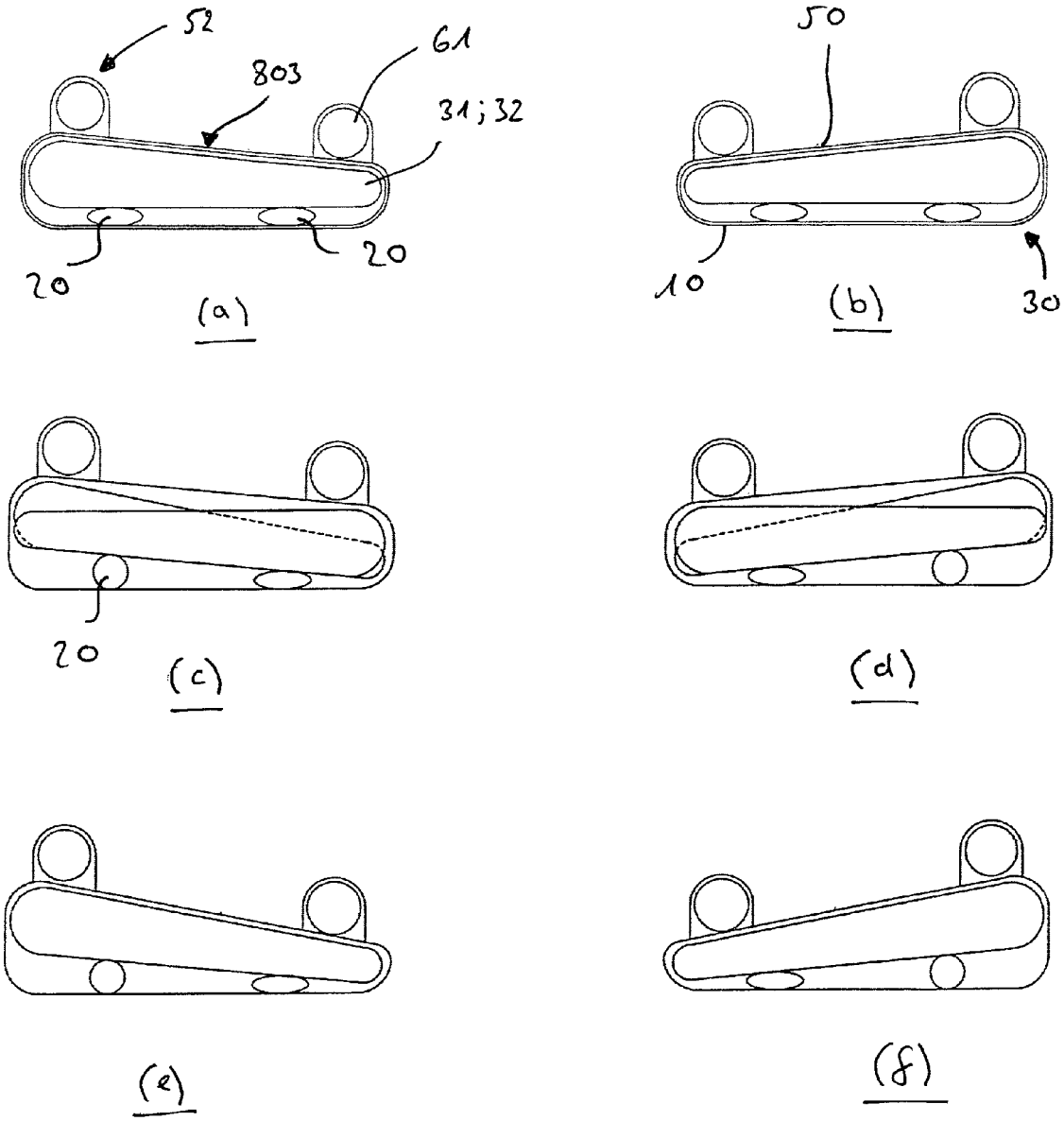
FIG. 10F a scheme of 6 operational end views in partial section of an embodiment of the air mattress, showing different inclination angles ((a)-(f))

An overview about the inclination conditions of the aforementioned medical air mattress and the possibility of inclining or rotating the patient with multiple angles is shown in FIG. 10F. The figure parts of FIG. 10F are related to a method to inflate/deflate a medical air mattress as described above. The air cells are inflated and/or deflated selectively. The even and/or odd air cells are inflated and/or deflated separately, such that either all even or all odd air cells are inflated or deflated, or such that all even and odd air cells are inflated. At least three inclination angles are achievable by selectively inflating and/or deflating inclination providing air cells and/or even body cells and/or odd body cells and/or even and odd body cells.

According to figure parts (a) and (b) either the even or the odd body air cells 32 are inflated. The inclination providing air cells 20 are both deflated. In this condition the surface is inclined in a first small angle, e. g. 10 degree or nearly 10 degree.

According to figure parts (c) and (d) the inclination providing air cells (20, 20A) are inflated either on the right or on the left side of the mattress body (30, 30A). Both, the even and the odd body air cells (31, 31A, 32, 32A, 23, 23A) are also inflated, so that the inclination angle according to figure part (c) and (d) is larger than it is the case in figure parts (a) and (b), e. g. nearly 20 degrees.

According to figure parts (e) and (f) the even or the odd body air cells (31, 31A, 32, 32A, 23, 23A) are inflated and one of the inclination providing air cell (20, 20A) is also inflated simultaneously. So the total inclination angle becomes even larger, e. g. nearly 30 degrees.

Figure 12A:
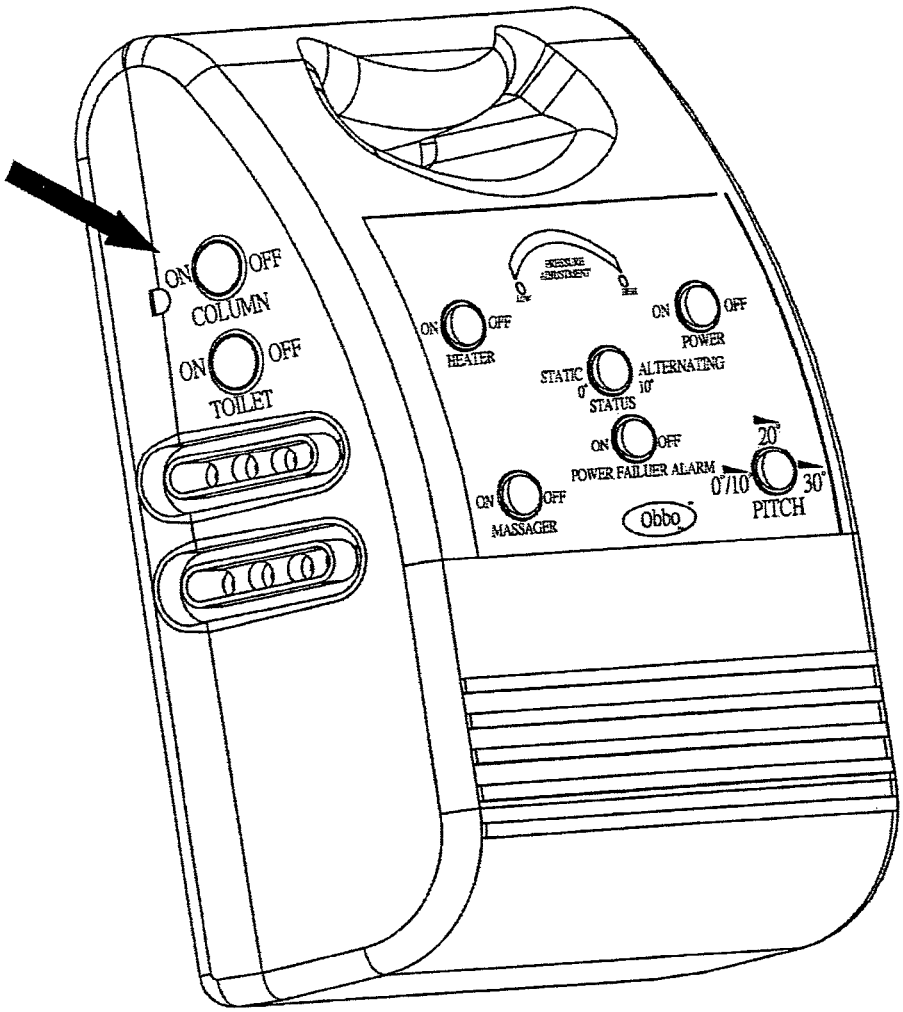
FIG. 12A/B perspective views of a control device of the medical air mattress according to the invention.
Figure 12B:
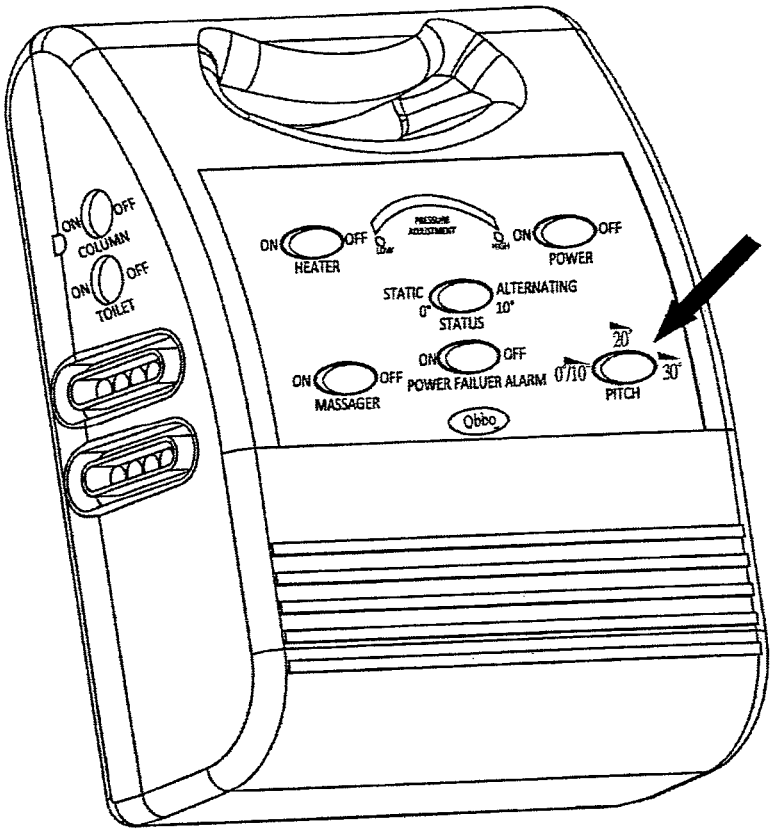

All of the conditions of the medical air mattress can be controlled by a control device shown in FIGS. 12 and 12B. The control device is connected to the pumping assembly and to all valves of the medical air mattress, e. g. shown in FIGS. 3A to 3D, 9A and 9B. Most of the conditions can be handled with a one touch-operation of the control device. Especially the inflation/deflation of the guardrail, of the cells which are engaged when inclining the mattress, or of independent air cells in order to provide a center portion of the mattress with a space to receive a container like a bedpan can be controlled with one-hand- or one touch-operation of the control device. All these functions and conditions can be operated by pressing only one button of the control device.

The medical air mattress in accordance with the present invention has numerous advantages. With the guardrail sleeves 52 formed on the top of the upper bedspread 50, the mutual drawing-force between the guardrail sleeves 52 from two opposite sides of the upper bedspread 50 holds the guardrail sleeves 52 in position to protect the patient 801 lying on the medical air mattress. Furthermore, the body air cells 31A in conical shape associated with the inclination providing air cells 20A provide multiple inclination angles. Therefore, different patients may choose a proper inclination angle they need or as instructed by the doctor.

Referring to FIGS. 2A, 2B and 8 a heat unit 51 is attached in the mattress body. Preferably it is positioned under the upper bedspread 50 for heating the upper bedspread. The heat unit 51 may be a carbon fiber electro thermal sheet. The heat unit 51 can be a component or in integral part of a heat-and-massage unit show in FIG. 2B.

Figure 11B:
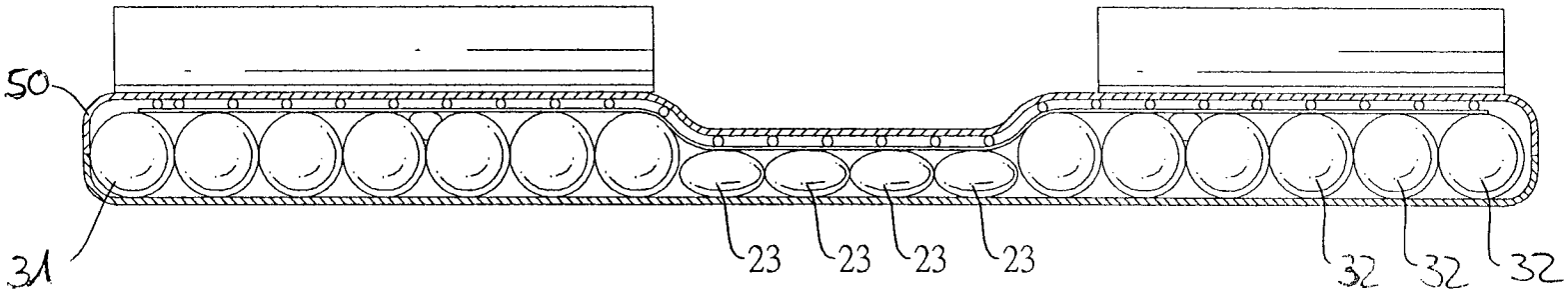
FIG. 11B an operational side view in partial section of the medical air mattress according to the invention, showing deflated independent air cells in a center region of the mattress body.

A medical air mattress with independent air cells 23 is shown in FIG. 11B. According to FIG. 11B a side view of the air mattress is shown. The body air cells 31 and the head air cells 32 are inflated. The independent air cells 23 are deflated, so that in the center region of the mattress body 30 a position for receiving a container like a toilet or a bedpan is generated. The position for receiving the container can have a nearly conical shape. Inflation or deflation of the independent air cells 23 can be controlled with the controller according to FIGS. 12A/B. By generating a concave position for receiving the bedpan it is no longer necessary to e. g. remove a part of the mattress body according to the state of the art (see FIG. 11A).

According to FIGS. 12A/B the controller of the medical air mattress is constructed in a way that several functions of the air mattress can be controlled by touching only one button. The inflation/deflation of the guardrail unit can be controlled with a one-touch-button for the guardrail-function (FIG. 12A, see arrow). One-touch-button means that touching the button once enables or disables the related function of the mattress. The inflation/deflation of the independent air cells 23 can be controlled with a one-touch-button of the toilet function. The inclination of the mattress surface at different angles can be controlled with a one touch-button for the inclination function (pitch, see arrow FIG. 12B). Touching the "pitch"-button increases or decreases the angle of the mattress surface according to the method described above. The alternating of the inflation of the (body and/or head) air cells can be controlled with a one-touch-button for the static/alternation function. The heating of the mattress can be controlled with a one-touch-button for the heater-function. The massage unit of the mattress can be controlled with a one-touch-button of the massage function. The controller according to FIGS. 12A/B can be positioned near the mattress body so that it can be operated by the medical staff or the patient himself.

Even though numerous characteristics and advantages of the present invention have been set forth in the foregoing description, together with details of the structure and features of the invention, the above disclosure is illustrative only. Changes may be made in the details, especially in matters of shape, size, and arrangement of parts within the principles of the invention to the full extent indicated by the broad general meaning of the terms in which the appended claims are expressed.

| REFERENCE NUMBERS | |
|---|---|
| 10 | lower bedspread |
| 20 | inclination providing air cell |
| 23 | independent air cell |
| 30, 30A | mattress body |
| 31, 31A | body air cell |
| 32, 32A | head air cell |
| 34A | offset air cell |
| 40 | massage unit |
| 41 | micro vibrator |
| 50, 50A | upper bedspread |
| 51 | heat unit |
| 52 | guardrail sleeve |
| 54 | odd independent pipeline |
| 55 | even independent pipeline |
| 60 | guardrail unit |
| 61 | guardrail air cell |
| 70 | pumping assembly |
| 71, 71A | pump |
| 72 | inclination providing pipeline |
| 73 | odd body pipeline |
| 74 | even body pipeline |
| 77 | guardrail pipeline |
| 78 | rapidly releasing valve |
| 80 | manual alternating device |
| 521 | sleeve body |
| 541 | odd solenoid valve |
| 551 | even solenoid valve |
| 701 | inclination providing alternating valve |
| 702 | body alternating valve |
| 703 | inclination providing solenoid valve |
| 731 | first check valve |
| 741 | second check valve |
| 771 | third check valve |
| 772 | guardrail solenoid valve |
| 772A | manual alternating device |
| 800 | base |
| 801 | patient |
| 803 | bearing surface |
| 804 | first layer |
| 805 | second layer |
| 806 | vibration unit |
| 807 | holding bag |

The invention claimed is:

1. A medical air mattress comprising a lower bedspread;

a mattress body positioned on the lower bedspread, said mattress body having a longitudinal axis and a lateral axis which is perpendicular to said longitudinal axis, said mattress body comprising multiple body air cells, multiple head air cells, and multiple independent air cells, the body, head and independent air cells are arranged substantially parallel to each other and arranged in a row forming an air cell row, a plurality of said air cells extending a width of said mattress body, a plurality of said head air cells positioned at a top portion of said mattress body, said independent air cells spaced from said bottom of said mattress body, a plurality of said head air cells positioned adjacent one another, a plurality of said head air cells are spaced from said a plurality of said independent air cells by a plurality of said body air cells, a plurality of independent air cells are positioned between the body air cells, said body air cells, said head air cells, and said independent air cells independently deflatable and inflatable from one another;

a guardrail above a top surface of said mattress body, said guardrail positioned on at least one side of said mattress body, said guardrail having a longitudinal axis that is parallel to said longitudinal axis of said mattress body, said guardrail including at least one guardrail air cell, said guardrail includes first and second guardrail systems, said first guardrail system positioned on one side of said mattress body and said second guardrail system positioned on an opposite side of said mattress body, said first and second guardrail systems positioned parallel to one another, each of said first and second guardrail systems having a longitudinal axis that is parallel to said longitudinal axis of said mattress body, said first guardrail system including first and second guardrail air cells that are spaced apart from one another along said longitudinal axis of said mattress body, said second guardrail system including first and second guardrail air cells that are spaced apart from one another along said longitudinal axis of said mattress body;

an upper bedspread covering the mattress body and being connected to the lower bedspread; and a pumping assembly comprising:

a pump;

a pipeline connecting the pump with the air cells, the pipeline connecting the pump with the air cells to control inflating, deflating, or combinations thereof of the body and head air cells selectively, said pipeline configured to independently deflate and inflate said body air cells, said head air cells, and said independent air cells from one another, the pipeline including an odd body pipeline connecting the pump with the body and head air cells at odd positions of the air cell row; an even body pipeline connecting the pump with the body and head air cells at even positions of the air cell row, an odd independent pipeline connecting the pump with the independent air cells at odd positions of the air cell row, an even independent pipeline connecting the pump with the independent air cells at even positions of the air cell row; and a guardrail pipeline connecting said pump with guardrail, said guardrail pipeline enabling said at least one guardrail air cell in said guardrail to be independently inflatable and deflatable from said body air cells, said head air cells, and said independent air cells.

2. The medical air mattress according to claim 1, characterized in a rapidly releasing valve connected to an odd body pipeline and an even body pipeline.

3. The medical air mattress according to claim 1, characterized in two inclination providing air cells mounted longitudinally on the lower bedspread such that the mattress body is on top of the inclination providing air cells, near two longitudinal sides of the lower bedspread, and substantially parallel to each other, said two inclination providing air cells independent inflatable and deflatable from said body air cells, said head air cells, and said independent air cells.

4. The medical air mattress according to claim 1, characterized in a plurality of said body air cells, said head air cells, and said independent air cells being gradually tapered in diameter from a wide end to a narrow end along a longitudinal length of said body air cells, said head air cells, and said independent air cells, and adjacently positioned air cells having said taper in diameter positioned such that said wide end of one air cell is positioned next to said narrow end of an adjacently positioned air cell.

5. The medical air mattress according to claim 1, characterized in that the guardrail further comprises at least one guardrail sleeve fixed on at least one side of the upper bedspread, respectively formed adjacent to the longitudinal edges of the upper bedspread, each guardrail sleeve having at least one sleeve body that forms a sleeve cavity, said at least one guardrail air cell at least partially positioned in said sleeve cavity.

6. The medical air mattress according to claim 1, wherein said first guardrail system includes first and second guardrail sleeves connected to a top surface of said upper bedspread and which are spaced apart from one another, said second guardrail system includes first and second guardrail sleeves connected to said top surface of said upper bedspread and which are spaced apart from one another, said first guardrail air cell of said first guardrail system at least partially positioned in a sleeve cavity of said first guardrail sleeve of said first guardrail system, said second guardrail air cell of said first guardrail system at least partially positioned in a sleeve cavity of said second guardrail sleeve of said first guardrail system, said first guardrail air cell of said second guardrail system at least partially positioned in a sleeve cavity of said first guardrail sleeve of said second guardrail system, said second guardrail air cell of said second guardrail system at least partially positioned in a sleeve cavity of said second guardrail sleeve of said second guardrail system.

7. The medical air mattress according to claim 5, characterized in the guardrail sleeve having a flat base with a double stitched line, and directly fixed on the surface of the upper bedspread.

8. The medical air mattress according to claim 1, characterized in a massage unit mounted on the mattress body having multiple micro vibrators.

9. The medical air mattress according to claim 1, characterized in a heat unit in form of an electro thermal sheet.

10. The medical air mattress according to claim 9, characterized in that the heat unit is attached to the upper bedspread.

11. The medical air mattress according to claim 9, characterized in that the heat unit is made of carbon fiber.

12. The medical air mattress according to claim 1, characterized in the pumping assembly further comprising:

a body alternating-valve connected to the pump, or between the pump with body pipelines and the guardrail pipeline;

a first check valve connected between the odd body pipeline and head air cells at odd positions of the air cell row; and a second check valve connected between the even body pipeline and head air cells at even positions of the air cell row.

13. The medical air mattress according to claim 1, characterized in the pumping assembly further comprising:

a guardrail solenoid valve connected between a body alternating-valve and the guardrail pipeline; and a third check valve mounted between the body alternating-valve and the guardrail solenoid valve; and/or an inclination providing solenoid valve connected to the pump; and an inclination providing alternating-valve connected between the inclination providing solenoid valve and the inclination providing pipeline; and/or an inclination providing solenoid valve connected to the pump; and an inclination providing alternating-valve connected between the inclination providing solenoid valve.

14. The medical air mattress according to claim 1, characterized in that each body air cell and/or each head air cell are essentially uniform in diameter.

15. The medical air mattress according to claim 1, characterized in the pumping assembly further comprising:

a body alternating-valve connected between the pump with the body pipelines and the guardrail pipeline;

a first check valve connected between an odd body pipeline and the head air cells at odd positions of the air cell row; and a second check valve connected between an even body pipeline and the head air cells at even positions of the air cell row.

16. The medical air mattress according to claim 1, characterized in the pumping assembly further comprising:

a manual alternating device connected between the body alternating-valve and the guardrail pipeline; and a third check valve mounted between the body alternating-valve and the manual alternating device.

17. The medical air mattress according to claim 1, characterized in that the pumping assembly comprises an independent deflating unit connected to the independent air cells.

18. The medical air mattress according to claim 1, characterized in that each body air cell and/or each head air cell and each independent air cell are respectively uniform in diameter.

19. The medical air mattress according to claim 1, characterized in that each independent air cell gradually tapers in diameter from a wide end to a narrow end.

20. The medical air mattress according to claim 19, characterized in that the independent air cells are arranged with wide ends adjacent to the narrow ends.

21. The medical air mattress according to claim 1, characterized in that an independent deflating unit comprises an odd solenoid valve and an even solenoid valve and has a deflating opening to the exterior, said odd independent pipeline connected to said odd body pipeline via said odd independent solenoid valve, said even independent pipeline connected to said even body pipeline via said the even independent solenoid valve, a plurality of said independent air cells are selectively deflated independently from one another via the odd and even solenoid valves;

the pumping assembly comprises a body alternating-valve connected between the pump with the body pipelines and the independent pipelines.

22. The medical air mattress according to claim 1, characterized in that an independent deflating unit comprises an odd solenoid valve and an even solenoid valve, having a deflating opening to the exterior, said odd independent pipeline connected to said odd body pipeline via said odd independent solenoid valve, said even independent pipeline connected to said even body pipeline via said the even independent solenoid valve, a plurality of said independent air cells are deflatable independently via the odd and even solenoid valves.

23. The medical air mattress according to claim 1, characterized in that an independent deflating unit comprises a manual alternating device connected between the body pipelines and the independent pipelines.

24. The medical air mattress according to claim 1, characterized in that an independent deflating unit comprises a manual alternating device connected between the body pipelines and the independent pipelines; and in that the pumping assembly further comprises:

a body alternating-valve connected between the pump with the body pipelines and the independent pipelines; a first check valve connected between the odd body pipeline and the odd head air cells; and a second check valve connected between the even body pipeline and the even head air cells.

25. The medical air mattress according to claim 1, characterized in at least one offset air cells mounted longitudinally and on one side of the mattress body and enlarging the bearing surface of the medical air mattress and/or supporting the upper bedspread.

26. The medical air mattress according to claim 25, characterized in that the offset air cell is connected to the pipeline connecting to the body air cells and/or to the head air cells protected by check valves.

27. A method to inflate/deflate a medical air mattress as defined in claim 1, wherein the mattress comprising a lower bedspread, a mattress body mounted on the lower bedspread with multiple body air cells and multiple head air cells, substantially parallel to each other and arranged in a row forming an air cell row, a pumping assembly with a pump and at least a pipeline connecting the pump with the air cells, characterized in that the air cells are inflated and/or deflated selectively.

28. A method to incline the bearing surface of a medical air mattress as defined in claim 1, wherein the medical air mattress comprising a lower bedspread, a mattress body mounted on the lower bedspread with multiple air cells arranged in a row forming an air cell row, wherein even air cells are on a even positions of the air cell row and odd air cells on odd positions of the air cell row, and the air cells are gradually tapered in diameter from a wide end to a narrow end, the air cells being arranged with wide ends adjacent to the narrow ends, characterized in that the even and/or odd air cells are inflated and/or deflated separately, such that either all even or all odd air cells are inflated or deflated.

29. The method according to claim 28, characterized in that the inflating/deflating of selectively chosen air cells is performed by a one-hand operation by operating a control device with at least one one-touch button controlling the inflation/deflation.

30. The method according to claim 28, characterized in that at least three inclination angles are achievable by selectively inflating and/or deflating inclination providing air cells and/or even body cells and/or odd body cells and/or even and odd body cells.

31. A method to generate in medical air mattress a position for receiving a container or a toilet bedpan, the mattress in accordance with claim 1 and comprising a lower bedspread, a mattress body mounted on the lower bedspread with multiple body air cells and/or multiple head air cells, substantially parallel to each other and arranged in a row forming an air cell row, a pumping assembly with a pump and at least a pipeline connecting the pump with the air cells, characterized in that the air cells are inflated and/or deflated independently, such that independent air cells arranged at a central part in the air cell row being independently connected to the pumping assembly are deflated to create a substantially concave position in the central part of the mattress body.

32. A medical air mattress comprising a lower bedspread;

a mattress body positioned on the lower bedspread, said mattress body having a longitudinal axis and a lateral axis which is perpendicular to said longitudinal axis, said mattress body comprising multiple body air cells, multiple head air cells, and multiple independent air cells which are all positioned parallel to said lateral axis of said mattress body, the body, head and independent air cells are arranged substantially parallel to each other and arranged in a row forming an air cell row, a plurality of said head air cells positioned at a top portion of said mattress body, said independent air cells spaced from said bottom of said mattress body, a plurality of said head air cells positioned adjacent one another, a plurality of said head air cells are spaced from said a plurality of said independent air cells by a plurality of said body air cells, a plurality of independent air cells are positioned between the body air cells, said body air cells, said head air cells, and said independent air cells independently deflatable and inflatable from one another;

first and second guardrail systems positioned above a top surface of said mattress body, said first guardrail system positioned on one side of said mattress body and said second guardrail system positioned on an opposite side of said mattress body, said first and second guardrail systems positioned parallel to one another, each of said first and second guardrail systems having a longitudinal axis that is parallel to said longitudinal axis of said mattress body, said first guardrail system including first and second guardrail air cells that are spaced apart from one another along said longitudinal axis of said mattress body, said second guardrail system including first and second guardrail air cells that are spaced apart from one another along said longitudinal axis of said mattress body;

an upper bedspread covering the mattress body and being connected to the lower bedspread; and a pumping assembly comprising:

a pump a pipeline connecting the pump with the air cells, the pipeline connecting the pump with the air cells to control inflating, deflating, or combinations thereof of the body and head air cells selectively, said pipeline configured independently deflate and inflate said body air cells, said head air cells, and said independent air cells from one another, the pipeline including an odd body pipeline connecting the pump with the body and head air cells at odd positions of the air cell row; an even body pipeline connecting the pump with the body and head air cells at even positions of the air cell row, an odd independent pipeline connecting the pump with the independent air cells at odd positions of the air cell row, an even independent pipeline connecting the pump with the independent air cells at even positions of the air cell row; and a guardrail pipeline connecting said pump with said first and second guardrail systems, said guardrail pipeline enabling said first and second guardrail air cells in said first and second guardrail systems to be independently inflatable and deflatable from said body air cells, said head air cells, and said independent air cells.

33. The medical air mattress according to claim 32, wherein said first guardrail system includes first and second guardrail sleeves connected to a top surface of said upper bedspread and which are spaced apart from one another, said second guardrail system includes first and second guardrail sleeves connected to said top surface of said upper bedspread and which are spaced apart from one another, said first guardrail air cell of said first guardrail system at least partially positioned in a sleeve cavity of said first guardrail sleeve of said first guardrail system, said second guardrail air cell of said first guardrail system at least partially positioned in a sleeve cavity of said second guardrail sleeve of said first guardrail system, said first guardrail air cell of said second guardrail system at least partially positioned in a sleeve cavity of said first guardrail sleeve of said second guardrail system, said second guardrail air cell of said second guardrail system at least partially positioned in a sleeve cavity of said second guardrail sleeve of said second guardrail system.

34. The medical air mattress according to claim 33, wherein a plurality of said body air cells, said head air cells, and said independent air cells being gradually tapered in diameter from a wide end to a narrow end along a longitudinal length of said body air cells, said head air cells, and said independent air cells, and adjacently positioned air cells having said taper in diameter positioned such that said wide end of one air cell is positioned next to said narrow end of an adjacently positioned air cell.

* * * * *